US006847796B2

(12) United States Patent
Chigono et al.

(10) Patent No.: US 6,847,796 B2
(45) Date of Patent: Jan. 25, 2005

(54) CHARGING MEMBER AND IMAGE FORMING APPARATUS PROVIDED WITH THE SAME

(75) Inventors: Yasunori Chigono, Shizuoka (JP); Koichi Okuda, Tokyo (JP); Yasushi Shimizu, Shizuoka (JP); Masahiro Yoshida, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/413,380

(22) Filed: Apr. 15, 2003

(65) Prior Publication Data

US 2003/0198484 A1 Oct. 23, 2003

(30) Foreign Application Priority Data

Apr. 17, 2002 (JP) ..... 2002-114427

(51) Int. Cl.[7] ..... G03G 15/02

(52) U.S. Cl. ..... 399/174; 361/225; 399/149; 399/176

(58) Field of Search ..... 399/174, 175, 399/176, 168, 149, 150; 430/902, 108.1, 108.24; 361/221, 225

(56) References Cited

U.S. PATENT DOCUMENTS

| | | | | |
|---|---|---|---|---|
| 5,380,614 A | | 1/1995 | Totsuka et al. | 430/108.24 |
| 5,502,548 A | | 3/1996 | Suzuki et al. | 399/110 |
| 6,038,414 A | | 3/2000 | Inami et al. | 399/104 |
| 6,061,539 A | | 5/2000 | Ishiyama et al. | 399/175 |
| 6,212,346 B1 | * | 4/2001 | Hirabayashi et al. | 399/176 |
| 6,226,480 B1 | * | 5/2001 | Hirabayashi et al. | 399/149 X |
| 6,291,123 B1 | | 9/2001 | Ohno et al. | 430/111.4 |
| 6,298,205 B1 | * | 10/2001 | Chigono et al. | 399/174 |
| 6,301,455 B1 | | 10/2001 | Ishiyama et al. | 399/102 |
| 6,389,254 B2 | | 5/2002 | Ishiyama et al. | 399/176 |
| 6,400,919 B1 | * | 6/2002 | Inoue et al. | 399/176 |
| 6,549,742 B1 | | 4/2003 | Chigono et al. | 399/174 |
| 6,615,010 B2 | * | 9/2003 | Hirabayashi et al. | 399/174 |
| 2002/0181970 A1 | | 12/2002 | Shimizu et al. | 399/149 |

FOREIGN PATENT DOCUMENTS

| | | | |
|---|---|---|---|
| EP | 0 864 936 A2 | | 9/1998 |
| JP | 06-003851 | * | 1/1994 |
| JP | 2002-132017 | * | 5/2002 |

* cited by examiner

*Primary Examiner*—Sophia S. Chen
(74) *Attorney, Agent, or Firm*—Fitzpatrick, Cella, Harper & Scinto

(57) ABSTRACT

A charging member for charging a member to be charged and an image forming apparatus provided with the same have electrically conductive particles and an electrically conductive particle bearing member having elasticity and bearing the electrically conductive particles thereon, and the degree of cohesion of the electrically conductive particles is 0.1 to 85%. Thereby, the non-uniformity of a halftone image peculiar to particle charging can be improved.

23 Claims, 7 Drawing Sheets

A: CONVENTIONAL TYPE ROLLER CHARGING APPARATUS (DISCHARGING TYPE CHARGING MECHANISM)

B: MAGNETIC BRUSH CHARGING APPARATUS (DIRECT INJECTING TYPE CHARGING MECHANISM)

CHARGING MEMBER AND IMAGE FORMING APPARATUS PROVIDED WITH THE SAME

BACKGROUND OF THE INVENTION

1. Field of the Invention

This invention relates to a charging member for charging a member to be charged. The invention also relates to an image forming apparatus such as a copying machine or a printer in which a charging member is brought into contact with a member to be charged to thereby charge the surface of the member to be charged.

2. Related Background Art

Heretofore, a contact charging apparatus has been one in which an electrically conductive charging member (a contact charging member or a contact charger) of a roller type (charging roller), a fur brush type, a magnetic brush type, a blade type or the like is brought into contact with a member to be charged such as an image bearing member, and a predetermined charging bias is applied to this contact charging member to thereby charge the surface of the member to be charged to a predetermined polarity and potential.

These charging apparatuses are expressed together as a contact charging apparatus, but the individual charging apparatuses differ greatly from one another in the viewpoint of the charging mechanism (the mechanism of charging and the principle of charging) thereof. In the charging mechanism of contact charging, there exist I. a discharging type charging mechanism and II. a direct injecting type charging mechanism. The feature of the charging apparatus is determined depending on by which charging mechanism the charging apparatus is. The principles and features of the discharging type charging mechanism and the direct injecting type mechanism will hereinafter be described.

I. Discharging Type Charging Mechanism

This is a mechanism in which the surface of a member to be charged is charged by a discharge product by a discharging phenomenon occurring in the gap between a contact charging member and the member to be charged.

A discharging type charging system has a constant discharging threshold value in the contact charging member and the member to be charged and therefore, as shown by A (a conventional type roller charging apparatus) in FIG. 5 of the accompanying drawings, it is necessary to apply a voltage greater than the potential of the member to be charged to the contact charging member. Also, as compared with a corona charger, a discharge product is created in principle though marked small in the amount created.

A roller charging process (roller charging apparatus) using an electrically conductive roller (charging roller) as the contact charging member by discharge is preferable in respect of the stability of discharge, and is widely used.

This charging roller for discharge is made by forming a rubber material or a foamed material of electrical conductivity or medium resistance into a roller shape as a base layer, and covering the surface thereof with a high resistance layer. In this construction, discharging phenomenon occurs in a gap with several of tens $\mu$m a little distance from the portion of contact between the roller and the member to be charged. Accordingly, in order to stabilize the discharging phenomenon, the surface layer of the roller is flat and the average roughness Ra of the surface is sub-$\mu$m or less, and the surface has high roller hardness.

Also, the roller charging by discharging is high in applied voltage and if there is a pinhole (the exposure of a substrate by the injury of the film of the member to be charged), a voltage drop will spread to even the periphery thereof and faulty charging will occur. Accordingly, the surface resistance of the surface layer is made equal to or greater than $10^{11}\Omega$ to thereby prevent the voltage drop.

II. Direct Injecting Type Charging Mechanism

Direct injecting type charging is a charging mechanism in which the exchange of charges is directly done by the contact at a molecular level between the contact charging member and the member to be charged to thereby charge (electrify) the surface of the member to be charged. It is referred to also as direct type charging or injecting type charging.

In this charging mechanism, the potential difference between the contact charging member and the member to be charged is of the order of several V to several tens of V. The charging characteristic thereof is shown by B (magnetic brush charging apparatus) in FIG. 5. The charging potential is equal to an applied voltage, and there is no applied voltage difference causing discharge. Also, the voltage necessary for charging is suppressed to a low level.

As described above, this direct type charging system as a charging mechanism does not result in the production of ions and therefore does not cause any evil by a discharge product. That is, it is a charging process excellent in terms of the safety of environment, the deterioration of the member and low electric power.

Description will now be made of a charging apparatus by the direct injecting type charging mechanism.

In the direct type charging mechanism, an important factor which determines charging performance is the contacting property between the contact charging member and the member to be charged. The contacting property herein referred to means the performance of the contact type charging member being capable of microscopically contact with how much of the surface of the member to be charged while the latter passes through the charging apparatus.

As a form of the contact charging member used in the direct injecting type charging apparatus, an attempt by a charging roller for discharging or the like has been made, but direct injecting type charging has been impossible by the charging roller for discharging. This is because in the high-hardness and smooth surface structure as previously described, the contact charging member appears to be in close contact with the member to be charged, but is scarcely in contact with the latter in the sense of a microscopic contacting property at a molecular level necessary for charge injection.

As a direct injecting type charging process proposed at present, there is particle charging using a magnetic brush.

Thinking of improvements in particle charging and contact density, a charging process (particle charging) using electrically conductive particles is advantageous. The electrically conductive particles used at this time are referred to as the "charging particles". As examples of an apparatus of a charging type using the charging particles, there have been proposed A. a magnetic brush charging apparatus using a magnetic brush charging member having magnetically restrained electrically conductive magnetic particles as the charging particles as a brush by a magnet, and B. a charging apparatus using a charging member having a thin electrically conductive particle layer formed on an elastic roller.

A. Magnetic Brush Charging Apparatus

FIG. 6 of the accompanying drawings is a model view schematically showing the construction of an example of the magnetic brush charging apparatus 100. The reference numeral 120 designates a magnetic brush charging member comprising a fixedly supported magnet roll 122, including magnetic poles N1, N2, S1, and S2, a nonmagnetic and electrically conductive charging sleeve 121 rotatably fitted around and concentrically with the magnet roll 122, and a magnetic brush layer (magnetic brush portion) 124 of electrically conductive magnetic particles C formed while being attracted to and held on the outer peripheral surface of the charging sleeve 121 by the magnetic force of the magnetic roll 122 in the charging sleeve. The reference numeral 123 denotes a casing to which the magnetic brush charging member 120 is assembled and in which a suitable amount of electrically conductive magnetic particles C is contained and stored. The reference numeral 125 designates a magnetic brush layer thickness regulating blade provided in the casing 123.

As the electrically conductive magnetic particles C which are charging particles causing the magnetic brush layer 124 to be constituted, use is made of magnetic metal particles such as ferrite or magnetite or these magnetic particles bound by resin. The resistance value thereof is $1\times10^6$ to $10^9$ Ωcm. The particle diameter thereof is 10 to 50 μm.

The charging sleeve 121 is rotatively driven in the same clockwise direction of the arrow as e.g. a photosensitive drum 1 as a member to be charged. The magnetic brush layer 124 is rotatively conveyed in a clockwise direction with the charging sleeve 121, and is regulated to a predetermined layer thickness by the blade 125, and the layer-thickness-regulated magnetic brush layer 124 contacts with the photosensitive drum 1 and rubs against the surface of the photosensitive drum 1 in a charging contact portion n. The magnetic brush layer 124 having passed through the charging contact portion n is return-conveyed to an electrically conductive magnetic particle reservoir portion in the casing 123 by the continued rotation of the charging sleeve 121, and is circularly conveyed and used.

A predetermined charging bias is applied from a charging bias applying voltage source V1 to the charging sleeve 121, and the surface of the photosensitive drum 1 is uniformly charged to a predetermined polarity and potential in the charging contact portion n by a direct injecting type charging mechanism with the aid of the rubbing by the magnetic brush layer 124 and the applied charging bias.

B. Charging Apparatus by Thin Layer Electrically Conductive Particles

FIG. 7 of the accompanying drawings is a model view schematically showing the construction of an example of a charging apparatus 20 by thin layer electrically conductive particles. This charging apparatus 20 has a charging roller 2 as a contact charging member, a charging bias applying voltage source S1 for the charging roller, and a charging particle supplying device 3.

The charging roller 2 comprises a mandrel 2*a* and an elastic medium-resistance layer 2*b* of rubber or a foamed material as a charging particle bearing member formed into a roller shape concentrically and integrally with the outer periphery of the mandrel 2*a*, and further has a thin layer of charging particles (electrically conductive particles) m borne on the outer peripheral surface of the elastic medium-resistance 2*b*.

This charging roller 2 is pressed into contact with the photosensitive drum 1 as the member to be charged with a predetermined amount of entry to thereby form a charging contact portion n of a predetermined width. The charging particles m borne on the charging roller 2 contact with the photosensitive drum 1 in the charging contact portion n.

The charging roller 2 is rotatively driven in the same clockwise direction of the arrow as the photosensitive drum 1, and is rotated in a direction opposite to the direction (counter-clockwise) of rotation of the photosensitive drum 1 in the charging contact portion n, whereby it contacts with the surface of the photosensitive drum 1 with a speed difference with the charging particles m interposed therebetween.

The relative speed difference of the charging roller 2 relative to the photosensitive drum 1 can be provided by rotatively driving the photosensitive drum in a direction counter to the direction of rotation of the charging roller 2 (a direction of rotation forward to the rotation of the photosensitive drum 1) at a different peripheral speed. The charging property of direct injecting type charging, however, depends on the ratio between the peripheral speed of the photosensitive drum 1 and the peripheral speed of the charging roller 2 and therefore, it is more advantageous in respect of the number of revolutions to rotatively drive the charging roller 2 in the same direction as the photosensitive drum 1, and it is also preferable in respect of the retain ability of the particles to adopt this construction.

During the image recording by an image recording apparatus, a predetermined charging bias is applied from a charging bias applying voltage source S1 to the mandrel 2*a* of the charging roller 2.

Thereby, the peripheral surface of the photosensitive drum 1 is uniformly contact-charged to a predetermined polarity and potential by a direct injecting type charging process.

The charging particles m applied to the outer peripheral surface of the charging roller 2 adhere to and are taken away by the surface of the photosensitive drum 1 with the charging of the photosensitive drum 1 by the charging roller 2. Accordingly, in order to make up for it, a charging particle supplying device 3 for the charging roller 2 is required. The application of the charging particles m to the charging roller 2 by the charging particle supplying device 3 is effected by agitating the charging particles m stored in the housing container 3*a* of the charging particle supplying device 3 by an agitating vane 3*b* and supplying them to the outer peripheral surface of the charging roller 2. Any charging particles m which become excessive in conformity with a target amount of application are scraped off by a fur brush 3*c* to thereby effect the application of a proper amount of charging particles. The control of the amount of application of the charging particles is adjustable at any time by the control of the number of revolutions of the fur brush 3*c*.

C. Aptitude of Particle Charging to a Cleanerless System

Particle charging is suitable for the toner recycle system of an image forming apparatus. That is, a toner recycle process is an excellent construction in a transfer type image recording apparatus wherein waste toner (untransferred toner) is used again for image forming to thereby effectively make the most of the toner and eliminate a space for a cleaner container and realize the downsizing of the image recording apparatus.

The untransferred toner is once introduced into a contact charging member and is made ready for reuse (the original amount of charge of the toner) and is returned to a developing apparatus through an image bearing member and is used again for developing, or if unnecessary, is collected, whereby, toner recycle becomes possible. A charging apparatus used here is required to charge the image bearing member and in addition, to collect the untransferred toner and recharge the toner.

From the viewpoint as described above, an attempt is made to think of the aptitude of particle charging to toner recycle. A magnetic brush has the features that itself is comprised of particles and can move with a degree of freedom, and is great in contact area. Accordingly, in the magnetic brush, it becomes possible to advantageously realize such functions requisite in toner recycle as collecting the untransferred toner from on the image bearing member, and further making the charges of the introduced toner proper.

In the conventional charging technique as described above, however, it has become apparent that the image recording apparatus causes the following deterioration of the quality of image. Firstly, the problem of the uniformity of a halftone image. When a uniform image of a medium density area has been outputted, the has been a black streaked faulty image like a trace swept by a broom, and also in a halftone image, there has occurred a white spot-like faulty image of the order of 0.1 to 0.5 mm. Further, there has occurred a faulty image having its ground slightly developed, i.e., fog. Observing the state of the fog well, it has been characteristic that the fog toner is distributed with a certain unit. Particularly these are remarkable in the lowering of performance under a high-temperature high-humidity environment. Also, they have been remarkable in a printing test after the image recording apparatus has been left as it is for a long period.

SUMMARY OF THE INVENTION

It is an object of the present invention to provide a charging member and an image forming apparatus which improve the non-uniformity of a halftone image peculiar to particle charging.

It is another object of the present invention to provide a charging member and an image forming apparatus which improve fog peculiar to particle charging.

It is another object of the present invention to provide a charging member and an image forming apparatus which reduce the cohesiveness of electrically conductive particles.

It is another object of the present invention to provide an image forming apparatus which is suited for collecting a developer by a developing device by preventing the cohesion of electrically conductive particles coming off a charging member.

Further objects and features of the present invention will become more fully apparent from the following detailed description when read with reference to the accompanying drawings.

DETAILED DESCRIPTION OF THE PREFERRED EMBODIMENTS

<Embodiment 1>

Figure 1:
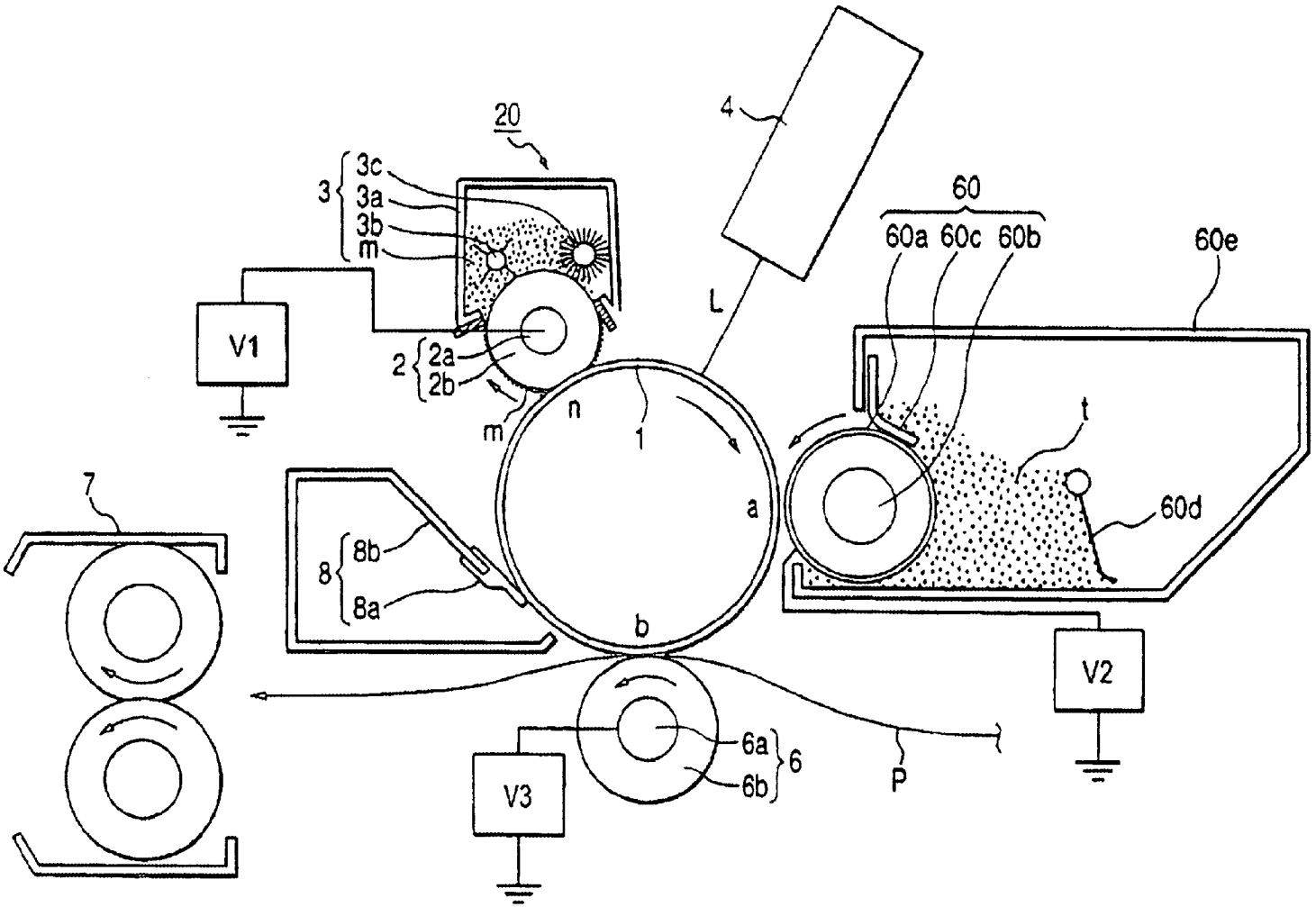
FIG. 1 is a schematic view of an image recording apparatus according to Embodiment 1.

FIG. 1 schematically shows the construction of a charging member according to the present invention or an image recording apparatus using the charging member. This image recording apparatus is a laser printer of a direct injecting type charging type utilizing a transfer type electrophotographic process.

(1) General Schematic Construction of the Image Recording Apparatus

The reference numeral 1 designates an image bearing member as a member to be charged, and in the present embodiment, it is a rotary drum-shaped negative polarity OPC photosensitive member (a negative photosensitive member, and hereinafter referred to as the photosensitive drum) having a diameter of 24 mm. This photosensitive drum is rotatively driven at a constant speed of a peripheral speed 47 mm/sec. (=process speed PS, i.e., a printing speed) in the clockwise direction of arrow. This photosensitive drum 1 will be described later in greater detail.

Figure 7:
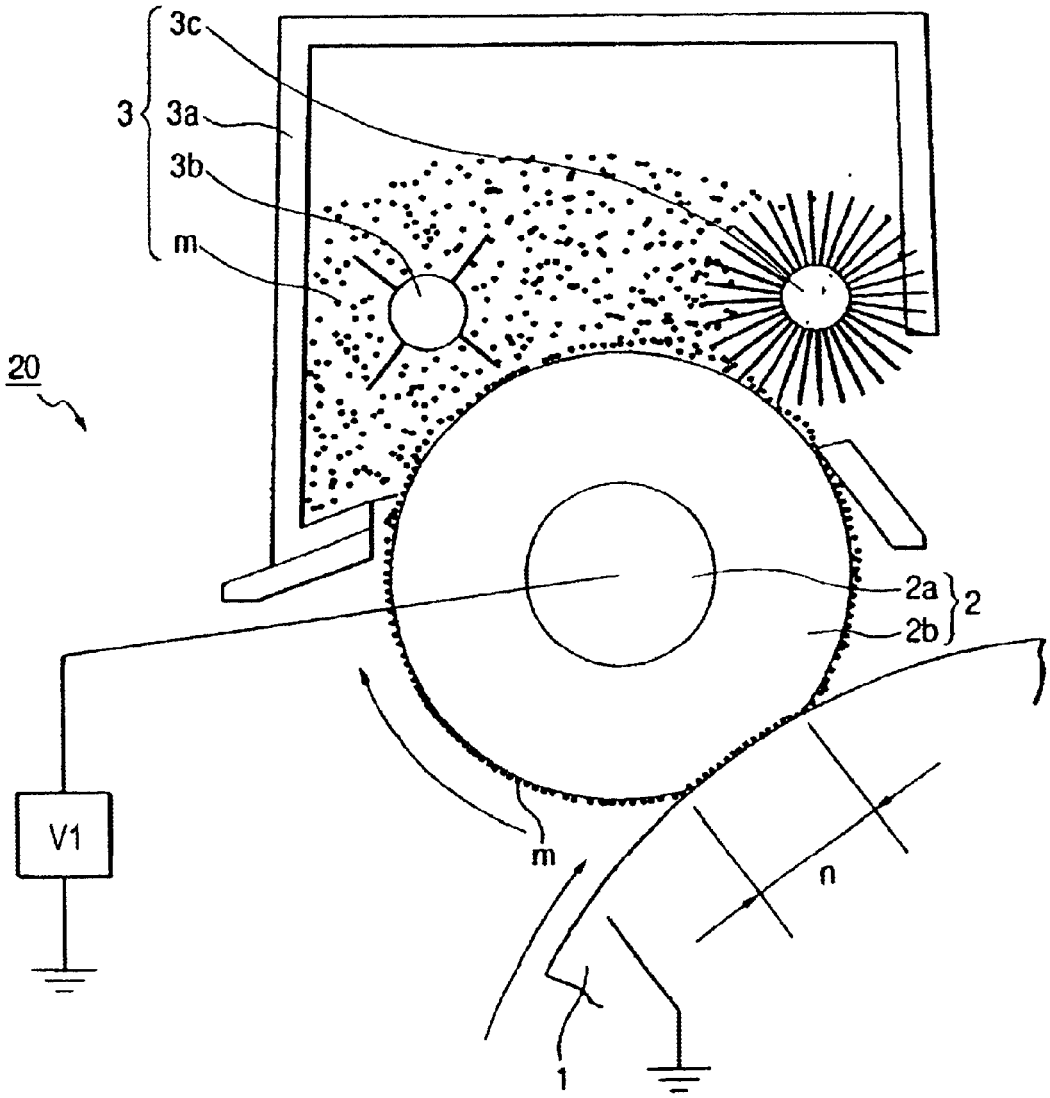
FIG. 7 is a schematic view of an example of a charging apparatus by thin-layer electrically conductive particles.

The reference numeral 20 denotes a charging apparatus which uniformly charges the peripheral surface of the photosensitive drum 1 being rotated to a predetermined polarity and potential. This charging apparatus 20 is similar to the aforedescribed charging apparatus of FIG. 7 by the thin layer electrically conductive particles, and has a charging roller 2 as a contact charging member, a charging bias applying voltage source S1 for the charging roller, and a charging particle supplying device 3 for the charging roller.

In the present embodiment, the peripheral surface of the photosensitive drum 1 is uniformly contact-charged to a predetermined polarity and potential by this charging apparatus 20 in a direct injecting type charging process. In the present embodiment, a charging bias of −600V has been applied from the charging bias applying voltage source V1 to the mandrel 2*a* of the charging roller 2 to thereby obtain substantially the same charging potential as the applied charging bias on the surface of the photosensitive drum 1. The charging apparatus 2 and the direct injecting type charging will be described later in greater detail.

The reference numeral 4 designates a laser beam scanner (exposure apparatus) including a laser diode, a polygon mirror, etc. This laser beam scanner 4 outputs a laser beam intensity-modulated correspondingly to the time-serial electrical digital pixel signal of desired image information, and effects the scanning exposure L of the uniformly charged surface of the rotary photosensitive drum 1 by the laser beam.

By this scanning exposure L, an electrostatic latent image corresponding to the desired image information is formed on the surface of the rotary photosensitive drum 1.

The reference numeral 60 denotes a developing apparatus (developing device). The developing apparatus 60 in the present embodiment retains a magnetic toner (negative toner) t and coats a developing sleeve 60*a* with a constant amount of toner t. The toner t carries constant frictional electrification by the rubbing thereof against the developing sleeve 60*a*, and reversal-develops and visualizes the electrostatic latent image on the photosensitive drum 1 in a developing area a by a developing bias applied to between the developing sleeve 60*a* and the photosensitive drum 1 by a developing bias applying voltage source V2. The developing apparatus 60 will be described later in greater detail.

The reference numeral 6 designates a transfer roller of medium resistance as contact transferring means, and it is brought into predetermined pressure contact with the photosensitive drum 1 to thereby form a transferring nip portion b, a transfer material P as a recording medium is fed from a feed portion, not shown, to this transferring nip portion b at predetermined timing and a predetermined transfer bias voltage is applied from a transfer bias applying voltage source V3 to the transfer roller 6, whereby the toner image on the photosensitive drum 1 is sequentially transferred to the surface of the transfer material P fed to the transferring nip portion b.

The transfer roller 6 used in the present embodiment is one of a roller resistance value $5\times10^8\Omega$ comprising a mandrel 6*a* and a medium-resistance foamed layer 6*b* formed thereon, and transfer has been effected with a voltage of +2.0 kV applied to the mandrel 6*a*. The transfer material P introduced into the transferring nip portion b is nipped and transported by this transferring nip portion b, and the toner image formed and borne on the surface of the rotary photosensitive drum 1 is sequentially transferred to the surface side of the transfer roller by an electrostatic force and a pressure force.

The reference numeral 7 denotes a fixing device of a heat fixing type or the like. The transfer material P fed to the transferring nip portion b and having received the transfer of the toner image from the photosensitive drum 1 is separated from the surface of the rotary photosensitive drum 1 and is introduced into this fixing device 7, and is subjected to the fixing of the toner image and is delivered out of the image recording apparatus as an image-formed article (printed copy).

Then, the photosensitive drum 1 is again charged by the charging apparatus 20 and is repetitively used for image forming.

The reference numeral 8 designates a photosensitive drum cleaning apparatus for scraping off any untransferred toner residual on the photosensitive drum 1 by a cleaning blade 8*a* and collecting it in a waste toner container 8*b*.

Then, the photosensitive drum 1 is again charged by the charging apparatus 20 and is repetitively used for image forming.

(2) Photosensitive Drum 1

Figure 2:
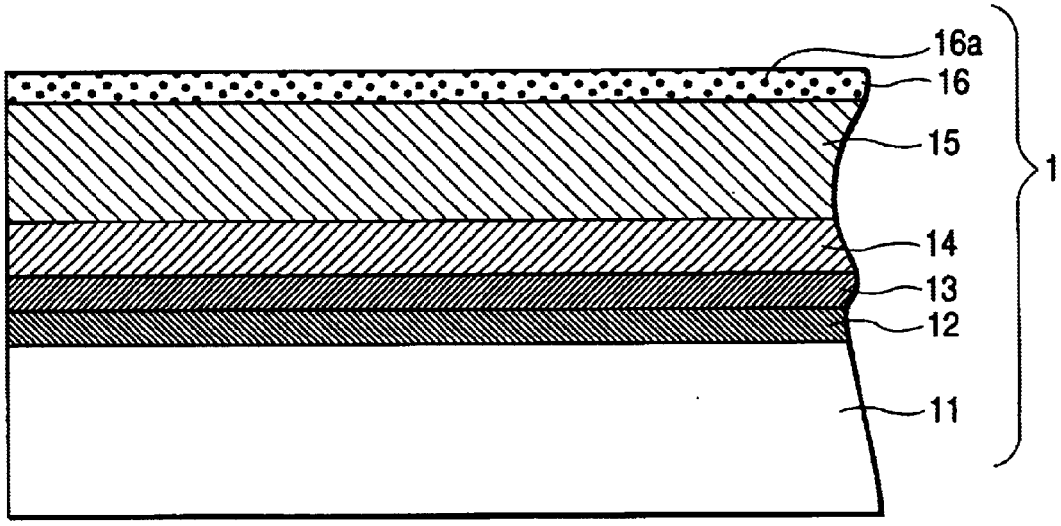
FIG. 2 is a model view showing the layer construction of a photosensitive drum.

FIG. 2 is a model view showing the layer construction of the photosensitive drum (electrophotographic photosensitive member) 1 used in the present embodiment. This photosensitive drum 1 is improved in charging performance by applying a charge injection layer 16 to an ordinary organic photosensitive drum comprising an aluminum drum base (Al drum base) 11 coated with an underlying layer 12, a positive charge injection preventing layer 13, a charge generating layer 14 and a charge transporting layer 15 in the named order.

The charge injection layer 16 comprises $SnO_2$ ultra-fine particles 16*a* (having a diameter of about 0.03 $\mu$m) as electrically conductive particles (electrically conductive filter), a polymerization initiator, etc. mixed with and dispersed in photo-curing type acrylic resin as a binder, and formed into film by a photo-curing method after coating.

Also, in addition, by causing a lubricant such as tetrafluoroethylene resin to be contained in it, there is the effect of suppressing the surface energy of the surface of the photosensitive drum to thereby generally suppress the adherence of the charging particles m. The surface energy, when expressed in terms of the contact angle of water, may probably be 85 degrees or greater, and more preferably be 90 degrees or greater.

Also, from the viewpoint of charging performance, the resistance of the surface layer of the surface becomes an important factor. In the direct injecting type charging process, it is considered that the resistance of the member to be charged is lowered, whereby the surface area of the member to be charged which can be charged per injection point (contact point) becomes wider. Accordingly, even if the charging roller is in the same contact state, when the resistance of the surface of the member to be charged is low, the efficient exchange of charges becomes possible. On the other hand, the member to be charged is used as a photosensitive member, it is necessary to retain an electrostatic latent image thereon for a predetermined time and therefore, a range of $1\times10^9$ to $1\times10^{14}$ ($\Omega\cdot$cm) is suitable as the volume resistivity value of the charge injection layer 16.

Also, even in the case of a photosensitive drum not using the charge injection layer 16, when for example, the charge transporting layer 15 is within the above-mentioned resistance range, an equal effect is obtained. Further, the use of an amorphous silicon photosensitive member or the like of which the volume resistivity of the surface layer is $10^{13}$ $\Omega\cdot$cm would also lead to the obtainment of a similar effect.

The resistance of the surface layer of the photosensitive drum 1 used in the present embodiment was $10^{12}$ $\Omega\cdot$cm.

(3) Charging Roller 2

The charging roller 2 in the present embodiment, as previously described, comprises a mandrel 2*a* and an elastic medium-resistance layer 2*b* of rubber or a foamed material as a charging particle bearing member formed into a roller shape around this mandrel 2*a* so as to be concentric and integral therewith. Charging particles (electrically conductive particles) m are borne on the outer peripheral surface of the elastic medium-resistance layer 2*b* of the charging roller 2. That is, the charging roller 2 and the electrically conductive particles m are provided as a charging member.

The elastic medium-resistance layer 2*b* was prescribed by resin (e.g. urethane), electrically conductive particles (e.g. carbon black), a sulfidizing agent, a foaming agent, etc. and was formed into a roller shape on the mandrel 2*a*. Thereafter, the surface thereof was polished.

The charging roller 2 in the present embodiment differs from a usually used charging roller for discharging in 1) the surface structure for bearing charging particles m of high density on the surface layer thereof and roughness characteristic, and 2) a resistance characteristic (volume resistivity and surface electrical resistance) necessary for direct injecting type charging.

1) Surface Structure and Roughness Characteristic

Heretofore, the roller surface by discharging has been flat and sub-$\mu$m or less in terms of the average roughness Ra of the surface, and has been high in roller hardness. In charging using discharging, a discharging phenomenon occurs in a gap with several of tens $\mu$m a little separate from the contact portion between the roller and the member to be charged. When unevenness is present on the surfaces of the roller and the member to be charged, magnetic field intensity partly differs and therefore, the discharging phenomenon becomes unstable and uneven charging occurs. Accordingly, the conventional charging roller requires a smooth and highly hard surface.

Then, considering why injection charging cannot be done by the charging roller for discharging, it appears to be in close contact with the photosensitive drum as the member to be charged in the surface structure as previously described, but it is scarcely in contact with the photosensitive drum in the sense of microscopic contact property at a molecular level necessary for charge injection.

On the other hand, a certain degree of roughness is required of the charging roller 2 in the present embodiment from the necessity of bearing the charging particles m highly density. In terms of the average is roughness Ra, 1 μm to 500 μm is preferable.

If the average roughness is smaller than 1 μm, a surface area for bearing the charging particles m is deficient, and when an insulator (e.g. the toner) or the like adheres to the surface layer of the roller, the periphery thereof becomes incapable of contacting with the photosensitive drum as the member to be charged, and charging performance lowers.

Also, when particle retaining capability is considered, it is preferable to have roughness greater than the particle diameter of the charging particles used.

When conversely, the roughness is greater than 500 μm, the unevenness of the surface of the roller lowers the charging uniformity in the surface of the member to be charged. In the present embodiment, Ra was 40 μm.

For the measurement of the average roughness Ra, surface shape measuring microscopes VF-7500 and VF7510 produced by Keyence Co., Inc. were used and the measurement of the shape and Ra of the surface roller was effected in non-contact by the use of an objective lens of 250 times to 1250 times.

2) Resistance Characteristic

The conventional type charging roller using discharge comprises a mandrel and a base layer of low resistance formed thereon, and thereafter having its surface covered with a high-resistance layer. Roller charging by discharge, if an applied voltage is high and there is a pinhole (the exposure of a substrate by the injury of film), voltage drop will reach even the periphery thereof and faulty charging will occur. Accordingly, it is necessary that the resistance of the charging roller be made equal to or greater than $10^{11}\Omega$.

On the other hand, in the direct injecting type charging process in the present embodiment, charging by a low voltage is possible and therefore, the surface layer of the contact charging member need not be made high in resistance, but the roller can be constituted by a single layer. Rather, in direct injecting type charging, it is preferable that the surface electrical resistance of the charging roller 2 be $10^4$ to $10^{10}\Omega$.

If the surface resistance becomes greater than $10^{10}\Omega$, a great potential difference occurs on the surface of the roller and therefore a discharge bias acts on the charging particles, and the charging particles become liable to be discharged. Also, the uniformity in the charging surface is lowered and the unevenness by the rubbing of the roller appears as a steak shape in a halftone image, and a reduction in the quality of image is seen.

On the other hand, when the surface electrical resistance is smaller than $10^4\Omega$, even in the case of injecting type charging, a peripheral voltage drop by the pinhole of the drum will occur.

Further, it is preferable that volume resistivity be within the range of $10^4$ to $10^7\Omega$. If the volume resistivity is smaller than $10^4\Omega$, the voltage drop of the voltage source by pinhole leak becomes liable to occur. On the other hand, if the volume resistivity is greater than $10^7\Omega$, an electric current necessary for charging cannot be secured and the charging voltage will drop.

The surface electrical resistance and volume resistivity of the charging roller 2 used in the present embodiment were $10^7\Omega$ and $10^8\Omega$, respectively.

Figure 3A:
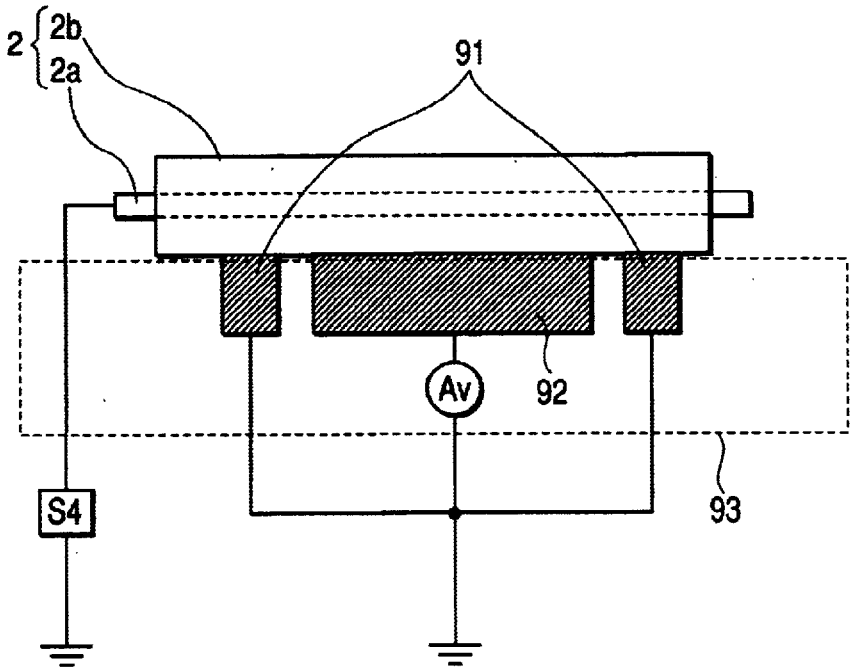
FIG. 3A is an illustration of a method of measuring the resistance value of a charging roller.
Figure 3B:
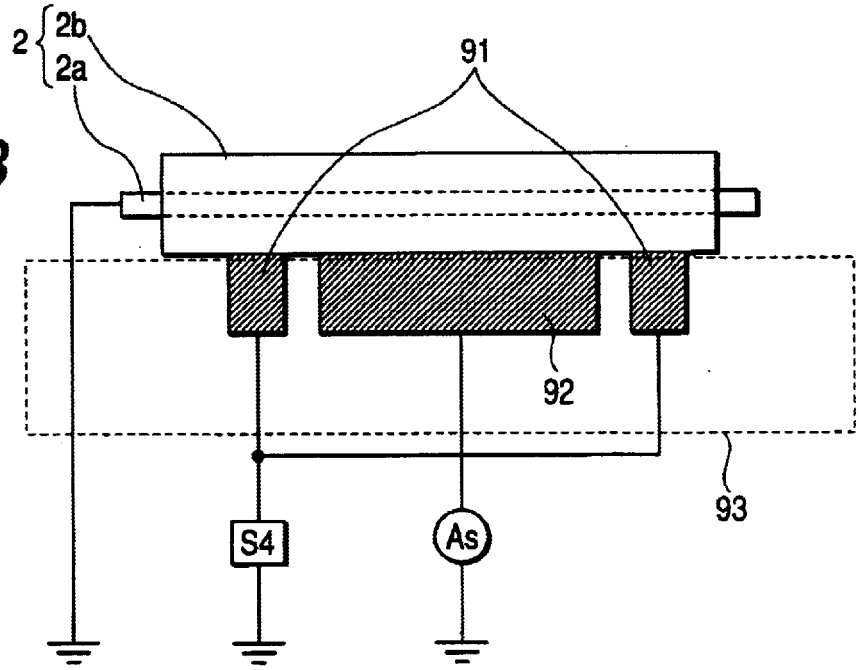
FIG. 3B is an illustration of the method of measuring the resistance value of the charging roller.

The resistance measurement of the charging roller 2 was carried out by the following procedure. The construction during the measurement is schematically shown in FIGS. 3A and 3B. The roller resistance was measured with an insulator drum 93 having an outer diameter of 24 mm being provided with electrodes so that total pressure of 9.8 N (1 kgf) might be applied to the mandrel 2*a* of the charging roller 2. As regards the electrode, a guard electrode 91 was disposed around a main electrode 92, and measurement was effected with wiring diagrams shown in FIGS. 3A and 3B. The distance between the main electrode 92 and the guard electrode 91 was adjusted to about the degree of the thickness of the elastic medium-resistance layer 2*b*, and the main electrode 92 kept a sufficient width relative to the guard electrode 91. As regards the measurement, +100V was applied from a voltage source S4 to the main electrode 92 and electric currents flowing through ammeters AV and AS were measured, and the volume resistivity and surface electrical resistance were measured.

As has hitherto been described, in the charging roller in the present embodiment, 1) A surface structure roughness characteristic in order to bear charging particles of high density on the surface layer, and 2) A resistance characteristic (volume resistivity and surface electrical resistance) necessary for direct charging are necessary.

3) Other Roller Characteristics

In the direct injecting type charging process, it is important for the contact charging member to function as a flexible electrode.

In the magnetic brush, this is realized by the flexibility the magnetic particle layer itself has.

In the charging apparatus 20 in the present embodiment, this is achieved by adjusting the elastic characteristic of the elastic medium-resistance layer 2*b* of the charging roller 2. In terms of Asker C hardness, 15 degrees to 50 degrees is a preferable range 20 to 40 degrees is more preferable.

If the hardness is too high, a necessary amount of entry is not obtained, and the charging contact portion n cannot be secured between the contact charging member and the member to be charged and therefore, charging performance is lowered. Also, the contact property of a substance at a molecular level is not obtained and therefore, the contact with the periphery thereof is hampered by the mixing or the like of a foreign substance.

On the other hand, if the hardness is too low, the shape of the contact charging member is not unstable and therefore the pressure of contact with the member to be charged becomes uneven to thereby cause uneven charging. Or there is caused faulty charging by the permanent deformation distortion of the roller by being left as it is for a long period.

In the present embodiment, use was made of a charging roller 2 of 20 degrees in terms of Asker C hardness. Further, the charging roller 2 was brought into contact with the photosensitive drum 1 with a total load of 1,000 g applied from the opposite end shafts of the roller. As the result, the roller entered by about 0.2 to 0.3 mm from the surface of the drum, and the width of the contact portion n between the roller and the drum was 2.7 mm.

4) Material, Structure and Dimensions of the Charging Roller

As the material of the elastic medium-resistance layer 2*b* of the charging roller 2, mention may be made of EPDM, urethane, NBR, silicone rubber, or a rubber material having carbon black for resistance adjustment or an electrically conductive substance such as a metal oxide dispersed in IR or the like. It is also possible to effect resistance adjustment by the use of an ion conductive material without dispersing an electrically conductive substance. Thereafter, the roughness adjustment of the surface and the shaping by polishing are carried out as required. A construction by a plurality of layers functionally separated from one another is also possible.

However, as the form of the elastic medium-resistance layer 2*b* of the charging roller 2, porous member structure is more preferable. This is also advantageous in manufacture in that the aforedescribed surface roughness can be obtained simultaneously with the molding of the roller. The cell diameter of a foamed material is appropriately 1 to 500 μm. After molding by foaming, the surface of the foamed material is polished to thereby expose the surface of the porous member, and it is possible to make surface structure having the aforedescribed roughness.

Finally, an elastic medium-resistance layer 2*b* of a layer thickness 6 mm having a porous member surface was formed on a mandrel 2*a* having a diameter of 6 mm and a length of 240 mm, and a charging roller 2 having a medium-resistance layer having a length of 220 mm was prepared.

(4) Charging Particles m

In the present embodiment, as the charging particles m, use was made of electrically conductive zinc oxide having specific resistance of $10^3$ Ω·cm and an average particle diameter 1.3 μm. The charging particles m are contained in the housing container 3*a* of the charging particle supplying device 3.

As the material of the charging particles m, use can be made of one of various electrically conductive particles such as electrically conductive inorganic particles such as other metal oxides, a mixture with an organic substance, or these materials subjected to surface treatment. Also, the charging particles m in the present invention need not be magnetically restrained and therefore need not have magnetism. Conversely, the charging particles (electrically conductive particles) m in the present embodiment is nonmagnetic and therefore, could be made small in particle diameter as compared with magnetic electrically conductive particles. Consequently, the electrically conductive particles can closely contact with the photosensitive member and therefore, the injecting type charging property can be improved.

As regards particle resistance, the exchange of charges through the particles is effected and therefore $10^{12}$ Ω·cm or less is necessary as specific resistance, and preferably $10^{10}$ Ω·cm or less is desirable. On the other hand, in order to prevent a leak trace when there is a pinhole in the drum, $10^{-1}$ Ω·cm or greater, preferably $10^2$ Ω·cm or greater is desirable.

Resistance measurement was effected by measuring and normalizing by the tablet method. That is, about 0.5 g of charging particles m was put into a cylinder having a bottom surface area of 2.26 $cm^2$, and pressure of 147N (15 kgf) was applied to upper and lower electrodes and at the same time, a voltage of 100V was applied thereto and the resistance value was measured and thereafter, was normalized to thereby calculate the specific resistance.

As regards the measurement of the particle diameter of the particles, D50 is calculated by a grain size distribution at a volume standard obtained with a liquid module attached to LS-230 type laser diffraction type grain size distribution measuring apparatus produced by COULTER Co., Inc. and with particle diameters of 0.04 to 2000 μm set as a measurement range. The measurement is effected with about 10 mg of particles added to 10 ml of methanol, and dispersed for 2 minutes by an ultrasonic dispersing machine, and thereafter under a condition that the measuring time is 90 seconds and the frequency of measurement is one time.

There is a case where the charging particles m exist not only in the state of primary particles, but also in the state of secondary particles in which the primary particles have cohered, but if the physical properties and function as the charging particles m can be realized as the secondary particles, it is possible to function as the charging particles. However, if the charging particles are formed by the secondary particles, an improvement in charging performance is seen while, on the other hand, fog and the lowering of the uniformity of a halftone image sometimes become remarkable. This is because the secondary particles tend to cohere further and this conversely causes a faulty image, and it becomes necessary to adjust the degree of cohesion to an appropriate range. The details of this will be described later.

It is desirable that the charging particles m, particularly when used for the charging of the photosensitive member, be white or nearly transparent so as not to hinder the exposure of the latent image. Further, considering that the charging particles m are partly transferred from the photosensitive member to a recording material, it is desirable in color recording that the charging particles m be colorless or white. That is, it is preferable that the charging particles m be nonmagnetic. Also in order to prevent the scattering of light by the particles during image exposure, it is desirable that the particle diameter of the charging particles m be equal to or smaller than the size of a constituent pixel, and further, equal to or smaller than the particle diameter of the toner. The lower limit value of the particle diameter is considered to be 10 nm as being stably obtained as particles.

That is, 0.01 to 10 μm is usable as the particle diameter. 0.1 to 5.0 μm is preferable. If the particle diameter is small, besides a problem in manufacture, the deterioration of the toner when the charging particles adhere to the toner is remarkable. If the particle diameter is large, it becomes difficult to maintain the charging performance when any change in environment is taken into consideration.

Further, in the present invention, from the viewpoint of the degree of cohesion of the particles, 0.5 to 3 μm is a preferable range of particle diameter of the charging particles.

Also, it is necessary for the particles to have an appropriate specific surface area. The specific surface area should preferably be $1\times10^5$ to $100\times10^5$ $cm^2/cm^3$. More preferably, it should be $5\times10^5$ to $100\times10^5$ $cm^2/cm^3$. If the specific surface area is smaller than this range, even if the charging particles are of the same particle diameter, the performance as the charging particles will lower. This is expected to be because if the specific surface area is small, the charging particles assume relatively simple surface structure and therefore the points of contact with the member to be charged are decreased. On the other hand, if the specific surface area is too great, the lowering of the performance of the toner has sometimes occurred particularly in a second embodiment. Particles particularly great in specific surface area tend to become weak in particle structure and incapable of maintaining a stable particle diameter.

The charging performance can be greatly improved by an increase in specific surface area, but particles great in specific surface area have the tendency that the cohesion of the particles becomes great. As the result, a faulty image which is a problem peculiar to the present invention becomes liable to occur. Accordingly, it leads to the realizability of charging particles of higher performance to increase the specific surface area and also, pay attention to the degree of cohesion and carry out various kinds of surface treatment for selecting particles or weakening cohesion.

The measurement of the specific surface area of the particles was carried out in the following manner.

First, in accordance with BET method, nitrogen gas is adsorbed to the surface of a sample by the use of a specific surface area measuring apparatus "Gemini 2375 Ver. 5.0" (produced by Shimazu Works Ltd.), and BET specific surface area ($cm^2/g$) is calculated by the use of BET multipoint method.

Next, true density ($g/cm^3$) is found by the use of a dry type automatic densimeter "Accupyc 1330" (produced by Shimazu Works Ltd.). At this time, by the use of a sample container of 10 $cm^3$, helium gas purge is carried out ten times at maximum pressure of 19.5 psig as sample pretreatment. Thereafter, if as a pressure equilibrium judging value as to whether the pressure in the container has reached equilibrium, the deflection of the pressure in the sample chamber is equal to or smaller than 0.0050/min as a standard, it is regarded as an equilibrium state and measurement is started to thereby automatically measure true density. The measurement is effected five times, and the average value thereof is found and is used as the true density.

Here, the specific surface area of powder (particle) can be found in the following manner.

Specific surface area ($cm^2/cm^3$)=BET specific surface area ($cm^2/g$)×true density ($g/cm^3$)

(5) The Amount of Borne Charging Particles

In particle charging, there is a method of making the particle diameter of the charging particles m small to thereby improve charging performance, but the coming off of the charging particles m to the photosensitive drum 1 becomes remarkable. The force with which the charging particles m can be retained on the charging roller 2 is a weak adhering force and therefore, even if many particles are supplied, it is difficult to restrain the particles, and the particles come off to the photosensitive drum 1 and suppress the influence upon the developing step thereafter and a faulty image onto transfer paper. Accordingly, ideally, it is desirable to more uniformly apply the particles to the surface layer of the charging roller, but actually, by adjusting the amount of borne charging particles, it becomes possible to secure a charging property and decrease the adhering particles.

It is necessary that the amount of borne particles be appropriately kept by the average roughness Ra of the surface of the roller. That is, it is desirable that a value obtained by dividing the amount of borne particles by the average roughness Ra be 1 or less, and more preferably be 0.3 or less.

The amount of borne nonmagnetic charging particles per the surface roughness Ra of the charging roller in the present embodiment is 1 $mg/cm^2/\mu m$ (50 $mg/cm^2$, Ra=50 $\mu m$) or less. More preferably, 0.3 $mg/cm^2/\mu m$ (15 $mg/cm^2$, Ra=50 $\mu m$) or less leads to a good result.

On the other hand, from the necessity of securing the charging performance, the minimum amount of borne particles is 0.005 $mg/cm^2/\mu m$ (0.25 $mg/cm^2$, Ra=50 $\mu m$) in terms also of the value of the amount of borne particles/Ra. More preferably, it is 0.02 $mg/cm^2/\mu m$ (1 $mg/cm^2$, Ra=50 $\mu m$).

That is, it is desirable that the amount of borne particles/Ra be 0.005 to 1, and more preferably be 0.02 to 0.3 $mg/cm^2/\mu m$.

In the present embodiment, the amount of borne particles was adjusted to 0.1 $mg/cm^2/\mu m$ (4 $mg/cm^2$, Ra=40 $\mu m$).

The adjustment of the amount of borne particles was effected by adjusting the number of revolutions of the fur brush 3*c* of the charging particle supplying device 3. The higher is the speed of the brush, the lower the amount of borne particles can be set. Also, adjustment was effected depending on the rotational speed of the agitating vane 3*b* and the density of the fur brush 3*c*, as required.

As regards the measurement of the amount of borne particles, the particles borne on the charging roller were washed and the measurement of the weight and resistance of the particles was effected.

A washing liquid comprising ethanol and water (1:2) was prepared in an ultrasonic washing device, and the roller was dipped therein and washing was effected. By repeating the washing and confirming the surface of the roller by an optical microscope and at the same time, repetitively effecting the washing while rubbing against the surface of the roller by a blade as required, the adhering substance on the roller can be removed.

The thus obtained washing liquid is left stationary for 1 to 2 hours, and when it is apparently separable from the supernatant liquid, the supernatant liquid is removed. Thereafter, it was sufficiently dried at 105 degrees and the substance borne by the roller was extracted. The amount of borne particles is found as an amount of borne particles per unit area from the total weight of obtained particles and the surface area of the charging roller 2 (calculated from the length of the roller).

(6) The Degree of Cohesion of the Charging Particles

Even if the amount of borne charging particles is adjusted to an amount suited for the surface roughness of the bearing member, the coming-off of the particles from the charging member cannot be completely prevented. Particularly, the amount of particles coming off in a high-temperature high-humidity environment is great and the state of the particles having come off is vehement in cohesion and a faulty image such as the uniformity or fog of a halftone image is liable to occur. In the present invention, as the physical characteristic of charging particles, the evaluation of the degree of cohesion is newly adopted and excellent charging particles are chosen to thereby construct a charging apparatus, whereby it has become possible to suppress an adverse effect given to the charging performance and downstream process.

In the present invention, the usable degree of cohesion of the charging particles is 0.1% to 85%, and preferably is 60% or less.

As regards a method of measuring the "degree of cohesion of charging particles" in the present invention, use is made of the vibration screening machine of a powder tester (produced by Hosokawa Micron Co., Ltd.), and screens of 200 mesh (opening 75 $\mu m$), 100 mesh (opening 150 $\mu m$) and 60 mesh (opening 250 $\mu m$) are set on a vibrating table in the named order so that they may be superposed in the order of narrower opening, that is, so that 60 mesh may be uppermost. The amplitude of the vibrating table was adjusted so as to be within the range of 1 mm in terms of amplitude gauge, and an input voltage to the vibrating table was adjusted.

In case of the measurement, a sample (5 g) is added onto the set screen of 60 mesh (opening 250 $\mu m$), and vibration is applied thereto for about 15 seconds by a timer, whereafter the mass of the sample remaining on each screen is measured, and the degree of cohesion is obtained on the basis of the following formula. The smaller is the value of the degree of cohesion, the lower is the extent of cohesion of the charging particles.

Degree of cohesion (%)=(the mass (g) of the sample on 60 mesh screen/5 g×100+(the mass (g) of the sample on 100 mesh screen)/5 g×100×0.6+(the mass (g) of the sample on 200 mesh screen)/5 g×100×0.2

In the measurement of the degree of cohesion by the powder test, the fineness of the mesh of the screens is adjusted in conformity with the particle diameter and purpose, but in the present embodiment, from the influence of the cohesion of the particles upon an image, use was made of what is approximate to 0.3 mm (300 $\mu m$) which is the evaluation standard of white-spot-like image fault which will be described later. As the result, a close correlation was found out between the degree of cohesion of the particles and an image.

The measurement was carried out under an environment of 23 degrees and 60%, and the sample for measurement was left as it was under the same environment for 24 hours, whereafter the measurement was carried out.

Also, the sample for the measurement of the degree of cohesion of the charging particles is picked from on the charging roller 2 and is prepared. With regard to Embodiment 1, however, it is also possible to replace it with the particles stored in the particle supplying device 3.

In Embodiment 2 which will be described later, use is made of the following method. An adhering substance was picked by a method of picking the aforedescribed adhering substance on the charging roller 2, whereafter the adhering substance was dissolved in a toner-soluble solvent and a deposit after left as it was sufficiently dried and was used as a sample for the measurement of the degree of cohesion.

1) Lowering of the Degree of Cohesion of Charging Particles

Electrically conductive five particles are used as the charging particles, but the degree cohesion may sometimes rise due to the smallness of the particle diameter or the humidity absorption by the particles, and the cohesion of the adjacent particles is very liable to occur. To lower the degree of cohesion of the particles, various kinds of surface treatment are effective. Among them, various kinds of hydrophobic treatment or surface treatment by the addition of lubricant particles for lowering the adhering force between particles or the like is particularly effective. What is particularly important here is the problem of the adhering force between particles, and it is considered that this is lowered to a predetermined level, whereby an improvement in the quality of image can be achieved. However, when surface treatment is to be carried out, it is necessary to carry it out with the electrical resistance, the amount of treatment or the like of a treating agent taken into account. It is necessary to adjust the particles themselves so as to be within the aforedescribed resistance range.

Typical hydrophobic treatment prescription and the extraneous addition of a lubricant used in the present embodiment will be described hereinafter.

2) Hydrophobic Treatment Prescription

Various treating methods are usable as the hydrophobic treatment of the charging particles. As a treating agent, use can be made of silicone varnish, silicone oil, silane compounds, a silane coupling agent, organic silicon compounds, organic titanium compounds, zinc stearate, higher fatty acid or the like, and these may be used singly and together to carry out the treatment. Among them, the treatment by the silane coupling agent is particularly preferable, and is also advantageous in respect of manufacture because of its simplicity of treatment. Although the manufacturing method is not restricted in particular, mention may be made, for example, of a method of dispersing or dissolving the above-mentioned treating agent in a suitable solvent, adding charging particles thereto and agitating and mixing them, removing the solvent therefrom, drying and crushing them to thereby adjust the particle size thereof.

Also, the amount of treatment may preferably be 0.02 to 10 parts by mass relative to 100 parts by mass of the charging particles, and more particularly be 0.05 to 5 parts by mass, and particularly preferably be 0.1 to 2 parts by mass. If the amount of treatment is too small, the cohesion between the charging particles will increase and the charging particles will become liable to form cohering lumps when they come off from the charging device. On the other hand, if the amount of treatment is too great, the electrical conductivity of the charging particles will be hindered and sufficient direct injecting type charging will become incapable of being effected on the member to be charged.

3) Extraneous Addition of a Lubricant

As means for preventing the cohesion of the particles, the addition of a lubricant is effective. As the lubricant, use can be made of fluorine resin powder (such as polyvinylidene fluoride or polytetrafluoroethylene), silicone resin powder, fatty acid metal salt (such as zinc stearate or calcium stearate) or the like. Among them, the addition of silicone resin powder is preferable. The addition of a small amount of it can effectively prevent cohesion.

Also, the amount of treatment may preferably be 0.02 to 10 parts by mass relative to 100 parts by mass of charging particles, and more preferably be 0.05 to 5 parts by mass, and particularly preferably be 1 to 3 parts by mass. If the amount of treatment is too small, the cohesion between the charging particles will increase and the charging particles will become liable to form cohering lumps when they come off from the charging device. On the other hand, if the amount of treatment is too great, the electrical conductivity of the charging particles will be hindered, and sufficient direct injecting type charging will become incapable of being effected on the member to be charged.

Use can also be made of charging particles having their surfaces surface-treated by a lubricant after hydrophobic treatment.

(7) Developing Apparatus 60

The reference character 60*a* designates a nonmagnetic rotary developing sleeve as a developer bearing and conveying member containing a magnet roll 60*b* therein, and a toner t which is a developer provided in a developing container 60*e* is subjected to layer thickness regulation and charge impartment by a regulation blade 60*c* in the process of being conveyed on the rotary developing sleeve 60*a*. The reference character 60*d* denotes an agitating member for effecting the circulation of the toner in the developing container 60*e* and sequentially conveying the toner to the periphery of the sleeve.

The toner t coating the rotary developing sleeve 60*a* is conveyed to a developing region (developing area) a which is the opposed portion of the photosensitive drum 1 and the sleeve 60*a* by the rotation of the sleeve 60*a*. Also, a developing bias voltage is applied from a developing bias applying voltage source S5 to the sleeve 60*a*.

In the present embodiment, the developing bias voltage is a DC voltage having an AC voltage superimposed thereon. Thereby, the electrostatic latent image on the photosensitive drum 1 is reversal-developed by the toner t.

Toner t: the single-component magnetic toner t which is a developer was made by mixing binder resin, magnetic material particles and a charge controlling agent together and via the steps of kneading, crushing and classifying, and was prepared with a fluidizing agent or the like further added thereto as an extraneous additive. The average particle diameter (D4) of the toner was 7 $\mu$m.

<Embodiment 2>

Figure 4:
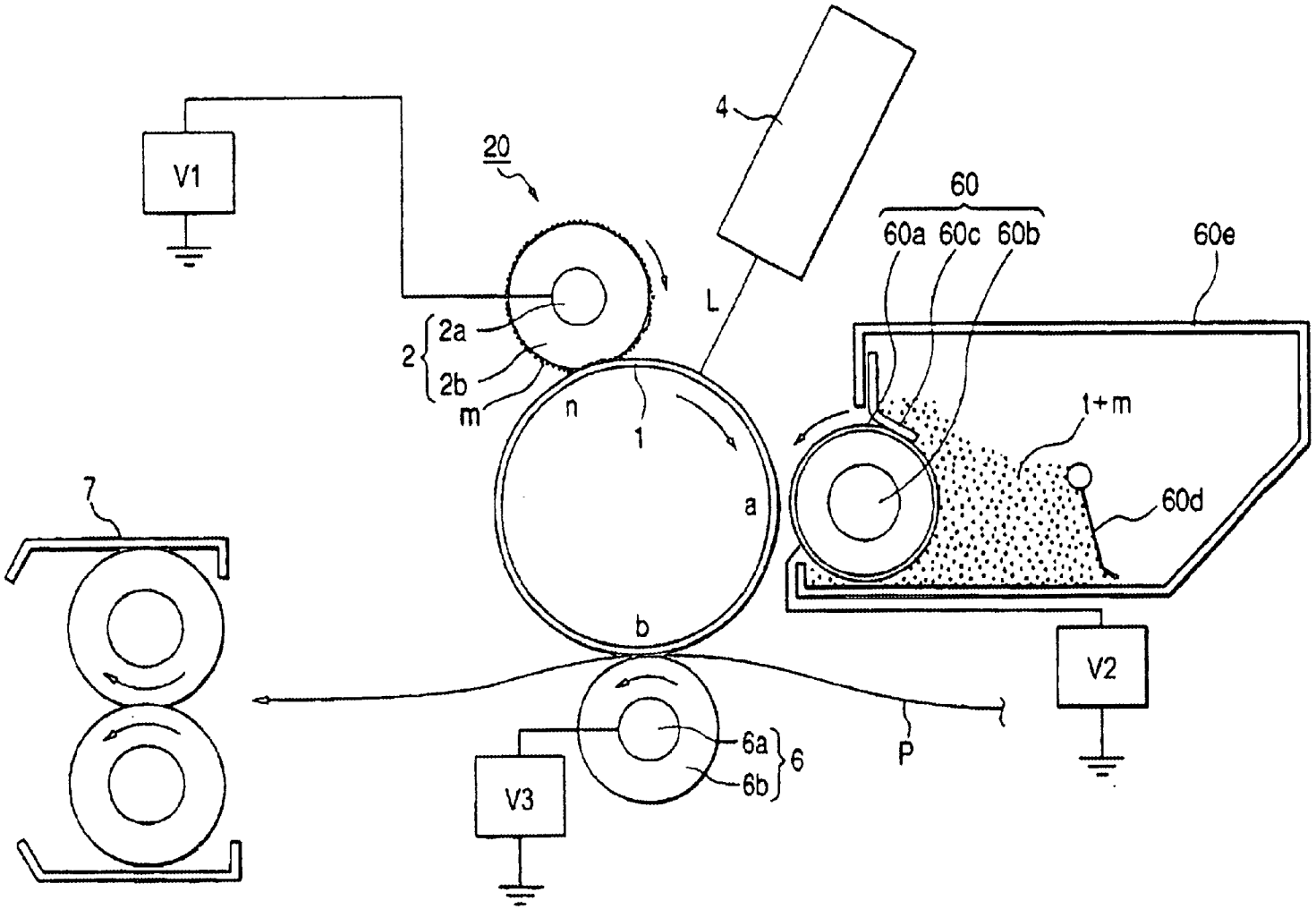
FIG. 4 is a schematic view of an image recording apparatus according to Embodiment 2.
Figure 5:
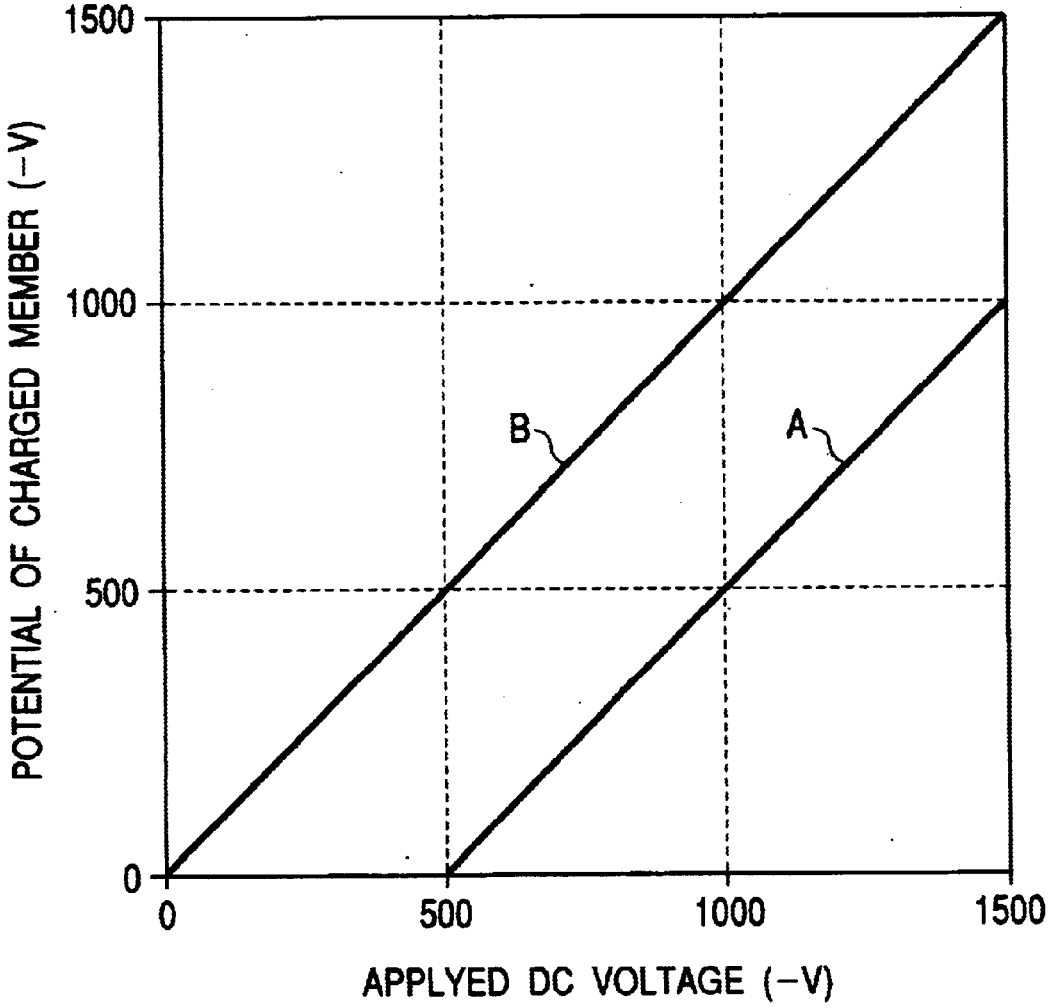
FIG. 5 is a charging characteristic graph of a conventional type roller charging apparatus and a magnetic brush charging apparatus.
Figure 6:
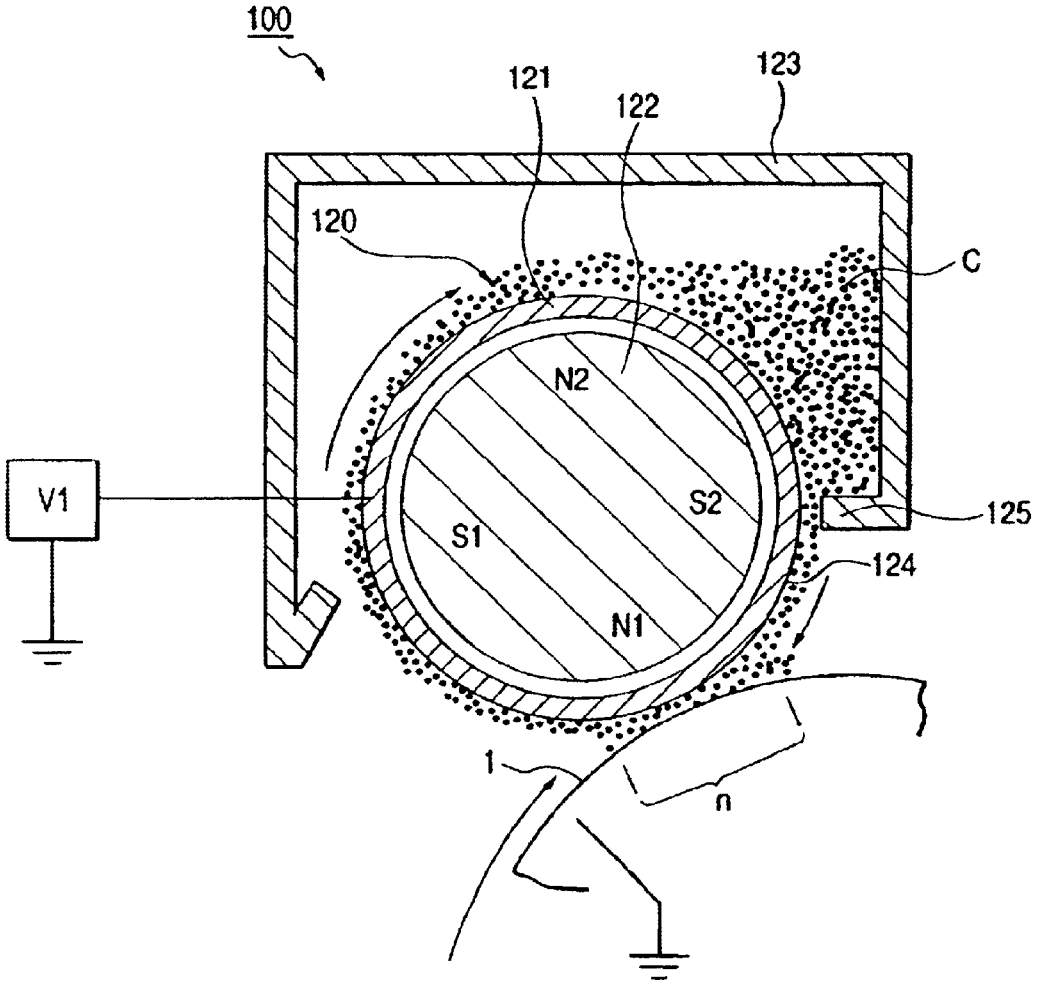
FIG. 6 is a schematic view of an example of the magnetic brush charging apparatus.

FIG. 4 schematically shows the construction of an image recording apparatus according to a second embodiment using the charging apparatus of the present invention.

The image recording apparatus according to the present embodiment is a laser printer of the direct injecting type charging type utilizing a transfer type electrophotographic process and a toner recycle process (cleanerless system). Points in which the image recording apparatus according to the present embodiment is similar to the aforedescribed image recording apparatus according to Embodiment 1 need not be described again, and different points will be described hereinafter.

The charging apparatus 20 is not provided with the charging particle supplying device 3 exclusively for the charging roller 2. Instead, the charging particles m are added to the developer t in the developing apparatus 60, and during the development of the electrostatic latent image on the photosensitive drum 1, they adhere to the surface of the photosensitive drum 1 with the toner, and are carried to the charging contact portion n by the rotation of the photosensitive drum 1, whereby they are supplied to the charging roller 2 through the intermediary of the photosensitive drum 1.

The developing apparatus 60 is a reversal developing apparatus using a single-component magnetic toner (negative toner). The developing apparatus contains therein a mixture t+m of the developer t and charging particles m. The electrostatic latent image on the surface of the rotary photosensitive drum 1 is developed as a toner image in a developing region a by the developing apparatus 60.

That is, the image recording apparatus according to the present embodiment adopts the toner recycle process, and any untransferred toner residual on the surface of the photosensitive drum 1 after image transfer is not removed by a cleaner (cleaning apparatus) exclusively therefore, but carried to the charging contact portion n with the rotation of the photosensitive drum 1, and is temporarily collected in the charging contact portion n by the charging roller 2 rotated in a direction counter to the direction of rotation of the photosensitive drum 1, and as the toner moves around the outer periphery of this charging roller, the reversed toner charges are normalized, and the toner is sequentially discharged to the photosensitive drum 1 and comes to the developing region a, and is collected for reuse by cleaning simultaneous with developing in the developing apparatus 60.

(1) Charging Apparatus 20

The present embodiment differs from Embodiment 1 in that the charging particle supplying device 3 is not disposed.

Also at the initial stage of use of the charging apparatus, it is preferable that the charging roller 2 be constructed as a charging member according to the construction of the present invention. The charging particles have the action of reducing the frictional force between the charging roller and the photosensitive member, and in a state free of the particles, not only great driving torque becomes necessary but also damage to the charging apparatus is also brought about. Also, by causing charging particles appropriately adjusted in degree of cohesion in accordance with the present invention to be borne in advance, the adherence of the particles to the photosensitive member which is liable to occur particularly when the image recording apparatus is left as it is under a high-temperature high-humidity environment for a long period can be suppressed.

(2) Developing Apparatus 60

The reference character 60*a* denotes a nonmagnetic rotary developing sleeve as a developer bearing and conveying member containing a magnet roll 60*b* therein, and the toner t in the mixture t+m before developing provided in a developing container 60*e* is subjected to layer thickness regulation and charge impartment by a regulation blade 60*c* in the process of being conveyed on the rotary developing sleeve 60*a*. The reference character 60*d* designates an agitating member for effecting the circulation of the toner in the developing container 60*e* and sequentially conveying the toner to the periphery of the sleeve.

The toner t coating the rotary developing sleeve 60*a* is conveyed to a developing region (developing area) a which is the opposed portion of the photosensitive drum 1 and the sleeve 60*a* by the rotation of the sleeve 60*a*. Also, a developing bias voltage is applied from a developing bias applying voltage source S5 to the sleeve 60*a*.

In the present embodiment, the developing bias voltage is a DC voltage having an AC voltage superimposed thereon. Thereby, the electrostatic latent image on the photosensitive drum 1 is reversal-developed by the toner t.

a) Toner t: the single-component magnetic toner which is a developer was made by mixing binder resin, magnetic material particles and a charge controlling agent together and via the steps of kneading, crushing and classifying, and was prepared with charging particles m and a fluidizing agent further added thereto as extraneous additives. The average particle diameter (D4) of the toner was 7 $\mu$m.

b) Charging particles m: Basically Embodiment 1 applies correspondingly, but the charging particles in the present embodiment somewhat differ in the appropriate particle diameter range thereof from those in Embodiment 1. The details thereof will be described later.

(3) Amount of Borne Charging Particles and Covering Rate a) Amount of Borne Charging Particles In the present embodiment which is of a toner recycle construction, as compared with Embodiment 1, much toner contaminates the surface of the charging roller. The toner has a resistance value of $10^{13}$ Ω·cm or greater in order to maintain the charges by triboelectrification on the surface thereof. Accordingly, when the charging roller 2 is contaminated by the toner, the resistance of the particles borne on the charging roller 2 increases and the charging performance thereof lowers. Even if the resistance of the charging particles is low, the resistance of the borne powder rises due to the mixing of the toner and a hindrance occurs to a charging property.

Accordingly, even if the amount of borne charging particles is 0.05 to 1, and preferably 0.02 to 0.3 mg/cm$^2$/$\mu$m in terms of the borne amount/Ra applying correspondingly to Embodiment 1, much toner is sometimes contained in the component thereof, and as a matter of course, the charging performance lowers.

In this case, the resistance of the borne particles rises and the situation can be grasped. That is, in an actually used state, the resistance of the particles (including mixed substances such as the toner and paper powder) borne on the charging roller 2 is measured by the aforedescribed method, and the value thereof is $10^{-1}$ to $10^{12}$ Ω·cm. Preferably, it is $10^{-1}$ to $10^{10}$ Ω·cm.

Further, in order to grasp the actually effective amount of presence in the charging by the charging particles m, it becomes more important to adjust the covering rate of the charging particles m. The charging particles m are white and therefore are distinguishable from the black of the magnetic toner. Areas presenting white in the observation through a microscope are found as an area rate. When the covering rate is 0.1 or less, it is insufficient as the charging performance even if the peripheral speed of the charging roller 2 is made higher and therefore, it becomes important to keep to covering rate of the charging particles m within the range of 0.2 to 1.

Also, the adjustment of the borne amount was basically effected by the adjustment of the amount of addition of the charging particles m to the development. Also, as required, an elastic blade was made to abut against a portion of the outer periphery of the charging roller 2 to thereby effect adjustment. By making the member abut against the charging roller, there is the effect of normalizing the polarity of the triboelectrification of the toner, and it becomes possible to adjust the amount of particles borne on the charging roller 2.

b) Measurement of the Covering Rate

Regarding the measurement of the covering rate, microscopic observation was effected in a state approximate to a roller abutting condition and an area covered with the electrically conductive particles was measured. Specifically, the rotation of the photosensitive drum 1 and the charging roller 2 was stopped with a charging bias being not applied, and the surfaces of the photosensitive drum 1 and the charging roller 2 were photographed by a video microscope (OVM 1000N produced by OLYMPUS) and a digital still recorder (SR-3100 produced by DELTS). With regard to the charging roller 2, the charging roller 2 was brought into contact with slide glass under the same condition as it was brought into contact with the photosensitive drum 1, and the surface of contact was photographed form the back of the slide glass by the video microscope with the aid of an objective lens of 1000 times. Thereafter, the area covered with the particles was separated with the color or brightness of the charging particles measured beforehand and the area rate thereof was found and used as a covering rate. Also, when discrimination by color was difficult, a substance on the outermost surface of the roller was analyzed by a fluorescent X-ray analyzing apparatus SYSTEM 3080 (produced by Rigaku Denki Kogyo Co., Ltd.) First, in an initial state, a polyester tape (No. 550 (#25) produced by Nichiban) is sandwiched between the charging roller covered with the charging particles and the drum with the adhesive surface of the tape facing the roller, and the drum and the roller were driven to rotate and the tape is once passed through the nip between the roller and the drum. At this time, on the surface of the tape, the particles on the outermost surface of the charging roller are further sampled. On the other hand, with regard also to the roller which has finished a printing test, sampling is likewise effected. The amount of content of a particular element contained in the electrically conductive particles is quantified, whereby the covering rate can be found. That is, with the tape sample on the roller bearing the electrically conductive particles alone thereon as 1, it becomes possible to calculate the rate of the sample after the printing test to thereby find the covering rate.

<The Points Aimed at by the Present Invention>

About a point of improvement in particle charging, description will hereinafter be made of the particulars of the development so far made and also, new points aimed at by the present invention and the directionality of improvement will hereinafter be described in detail.

(1) Particulars of the Development of the Particle Charging Apparatus

The charging performance of particle charging depends greatly on contact density, i.e., particle density. In the development of the charging apparatus as well, attention has been paid to how to improve particle density. In a magnetic brush charging apparatus, the diameter of magnetic particles has been made small to thereby achieve an improvement in the charging performance. However, there is a limit of 10 to 20 $\mu$m. This is because a constant magnetic restraining force becomes necessary for an electrostatic force created during the charging of the photosensitive member. The magnetic restraining force is greatly concerned with the particle diameter and a reduction in the restraining force gives rise to the problem of the coming-off of the particles. In order to break down this limit, there has been proposed a charging apparatus bearing a thin layer of electrically conductive fine particles thereon.

In this charging apparatus bearing a thin layer of electrically conductive fine particles thereon, the particle diameter is made small and the amount of borne particles is decreased and a thin layer of charging particles is formed, whereby a particle charging apparatus can be constructed in spite of a weak restraining force between substances. Specifically, particle charging of a particle diameter of 0.01 to 10 $\mu$m becomes possible, and charging performance has been markedly improved. The coming-off of the particles, however, has not become null. Although not so remarkable as in the case of magnetic particles of a large particle diameter, there have arisen such problems as fog and the lowering of the uniformity of a halftone image. It has been found that these problems are correlated with the charging particles having come off from the charging apparatus and are greatly changed by the particle prescription of the electrically conductive fine particles which are the charging particles. These have been improved by adjusting the amount of borne electrically conductive particles relative to the roughness of an electrically conductive particle bearing member. When the amount of borne particles is increased, the charging property is improved and black vertical streaked faulty images decrease. However, white spot-like faulty images increase and finally, the uniformity of an image is lowered. Also, fog tends to increase. Particularly from the fact that fog occurs with unevenness in the surface, it is anticipated that the cohering lumps of particles affect it.

On the other hand, when the amount of borne particles is decreased, white spot-like faulty images tend to decrease, but faulty charging occurs and streaked faulty images become conspicuous. When the amount of borne particles is further decreased, necessary charging potential is not obtained and fog and uniformity are both aggravated.

Also, as another means for improving the quality of image, there is the adjustment of the particle diameter. For particles of a large particle diameter, the drum charging property tends to lower and at the same time, white spot-like faulty images tend to increase. Also, for particles of a small particle diameter, the uniformity of an image is improved, but fog was difficult to improve.

As described above, the adjustment by the particle diameter and particle amount of the fine particles has so far been effected, but it has not become possible to obtain the performance which satisfies all of the above-noted problems.

Also, as means for improving the charging performance, there is an improvement in the specific surface area of the particles. By improving the specific surface are a such as forming the particles as secondary particles, the charging performance is greatly improved even for the same particle diameter. At the same time, however, the cohesion between particles tends to increase and the aforedescribed faulty image is liable to occur.

So, in the present invention, attention has been paid to the "cohesion" of the particles, and an improvement in the properties of the charging particles has been contrived to thereby attempt an improvement in the charging performance and an improvement in the faulty image due to the particles having come off. Examples and the advantages of the present invention will now be described.

EXAMPLES AND COMPARATIVE EXAMPLES

(1) Comparative Example 1

In the image forming apparatus according to Embodiment 1, conventional particles high in degree of cohesion were used as charging particles. The particles used had a particle diameter of 1.3 $\mu$m and a degree of cohesion of 88%.

(2) Example 1

In the image forming apparatus according to Embodiment 1, particles m having a particle diameter of 1.3 $\mu$m and a degree of cohesion of 60% is used as the charging particles m, and the application of the particles to the charging roller 2 is effected by the charging particle supplying device 3.

(3) Comparative Example 2

In the image forming apparatus according to Embodiment 2, conventional particles m having a particle diameter of 1.3 μm and a high degree of cohesion of 89% was used as the charging particles m, and 1 weight % of them was added to the developer.

(4) Example 2

This is the image forming apparatus according to Embodiment 2. As the charging particles m, use was made of particles subjected to silane coupling treatment (shown as treatment A in an evaluation result table) using n-bytyltrimethoxy silane as a treating agent. Also, the amount of treatment thereof was 1 weight % relative to the charging particles. Particles m having a particle diameter of 1.3 μm and a degree of cohesion of 85% were used as the charging particles, and about 1 weight % of them was added to the developer.

(5) Example 3

In the image forming apparatus according to Embodiment 2, as the charging particles m, use was made of particles m having a particle diameter of 1.3 μm and a degree of cohesion of 60% and subjected to treatment similar to that in Example 2 with an amount of treatment of 1.8 weight % for charging particles, and about 1 weight % of them was added to the developer.

(6) Comparative Example 3

In the image forming apparatus according to Embodiment 2, as the charging particles m, use was made of conventional particles having a particle diameter of 1.8 μm and a high degree of cohesion of 89%, and about 1 weight % of them was added to the developer.

(7) Example 4

In the image forming apparatus according to Embodiment 2, as the charging particles m, use was made of particles subjected to silane coupling treatment using n-bytyltrimethoxysilane as a treating agent.

Also, the amount of treatment thereof was 1 weight % relative to the charging particles. Use was made of particles m having a particle diameter of 1.8 μm and a degree of cohesion of 45%, and about 1 weight % of them was added to the developer.

(8) Example 5

This is the image forming apparatus according to Embodiment 2. As the charging particles m, use was made of particles subjected to treatment similar to that in Example 4, and thereafter having had 0.7 weight % of silica extraneously added thereto (shown as treatment B in the evaluation result table). The particle diameter was 1.8 μm, and the degree of cohesion was 43%. About 1 weight % of the particles was added to the developer.

(9) Example 6

This is the image forming apparatus according to Embodiment 2. As the charging particles m, use was made of particles subjected to treatment similar to that in Example 4, and thereafter having had 2.8 weight % of silica extraneously added thereto. The particle diameter was 1.8 μm, and the degree of cohesion was 25% about 1 weight % of the particles was added to the developer.

(10) Evaluating Method for Each Example and Each Comparative Example a) Image Evaluation Image evaluation was done after 2,000 sheets including the following halftone uniformity and fog. Also, a printing test was carried out under a high-temperature high-humidity environment of 32.5° C. and 80%.

The coverage of an image pattern was 5%, and the printing test was carried out by the use of a pattern having no difference in the coverage in the lengthwise direction.

b) Halftone Uniformity (Evaluation of a Faulty Image)

Image evaluation was done with halftone images outputted and from the number of faulty images. In the printer in each embodiment and each example, image recording was effected by the use of a 600 dpi laser scanner.

In this evaluation, the halftone image means a striped pattern in which a line in the main scanning direction is recorded, whereafter two lines are non-recorded, and generally expresses the density of a halftone.

The printer in each embodiment and each example effects image recording by a reversal developing system and therefore, both when image exposure is hindered and when a leak occurs during development, a white spot appears in the image.

Also, particularly due to the lowering of the charging performance, there may occur a black streaked faulty image like the sweeping trace of a broom.

Particularly in the present invention, importance was attached to the uniformity of halftone images and the number of the faulty regions of these was evaluated on the following standard. In the evaluation of a faulty image, white spots were counted with spots of 0.3 mm or greater as faulty regions and streaks were counted with lines of 5 mm or greater as faulty regions.

A: Less than ten image faults exist.

B: 10 to 50 image faults exist.

C: More than 50 and less than 100 image faults exist.

D: More than 100 image faults exist.

C) Fog Evaluation

Fog refers to such an image fault that in an unprinted white portion (unexposed portion), the toner is slightly developed and appears like a ground stain. Particularly in the present example, it is characteristic that a fog toner is created with unevenness in a striped shape, but evaluation was done by fog reflectance measurement correspondingly to the conventional evaluating method. The amount of fog was measured by measuring the optical reflectance by a green filter by an optical reflectance measuring machine (TC-6DS produced by Tokyo Denshoku Co., Ltd.), subtracting it from the reflectance of recording paper alone and finding an amount of reflectance corresponding to fog, and evaluating it as the amount of fog. The amount of fog was obtained by measuring 10 or more points on the recording paper and finding the average value thereof.

A: The amount of fog is 0 to 2.9%.

B: The amount of fog is 3.0 to 3.5%.

C: The amount of fog is less than 4.0%.

D: The amount of fog is 4.1% or greater.

(11) Evaluation Result

The evaluation results of each example and each comparative example are collectively shown below.

TABLE 1

Evaluation Result Table

| | Embodiment | Particle diameter of electrically conductive particles (μm) | prescription of electrically conductive particles (amount of treatment) | degree of cohesion of electrically conductive particles (%) | fog evaluation | halftone uniformity evaluation |
|---|---|---|---|---|---|---|
| Comparative Example 1 | Embodiment 1 | 1.3 | untreated | 88 | D | D |
| Example 1 | Embodiment 1 | 1.3 | treatment A (1.8%) | 60 | B | B |
| Comparative Example 2 | Embodiment 2 | 1.3 | untreated | 89 | D | D |
| Example 2 | Embodiment 2 | 1.3 | treatment A (1%) | 85 | C | C |
| Example 3 | Embodiment 2 | 1.3 | treatment A (1.8%) | 60 | C+ | C |
| Comparative Example 3 | Embodiment 2 | 1.8 | untreated | 88 | D | D |
| Example 4 | Embodiment 2 | 1.8 | treatment A (1%) | 45 | B | B |
| Example 5 | Embodiment 2 | 1.8 | treatment A (1%) & treatment B (0.7%) | 43 | B+ | B+ |
| Example 6 | Embodiment 2 | 1.8 | treatment A (1%) & treatment B (2.8%) | 25 | A | A |

The evaluation results of each example and each comparative example will hereinafter be described and also, the effectiveness of the present invention will hereinafter be described.

Comparative Example 1 is a case where the conventional electrically conductive fine particles were used to construct a particle charging apparatus. The degree of cohesion of the particles is high and reaches even 88%. The result of image evaluation was low in both of fog and halftone uniformity.

On the other hand, in Example 1 of the present invention, the degree of cohesion of the charging particles is as low as 60%. Image evaluation was good and at a rank B.

The difference between the two will now be described in detail. It will be seen that both are the same in the amount of particles borne on the charging member in order to keep constant charging performance, but differ greatly in the performance as the charging apparatus form each other. Particularly, the two differ greatly in the state of the particles having come off.

The conventional charging particles high in the cohering property appear to cohere in a spotted state in the observation on the photosensitive member as well. There is confirmed such a phenomenon as increased fog which would have heretofore adversely affected a process disposed downstream and caused white spot-like image faults to a halftone by charging particles having come off.

On the other hand, in the present example, there exist charging particles having come off, but cohesion in a spotted shape is reduced, and an adverse effect upon the downstream process is considered to have been improved.

Also, in comparative Example 1, a characteristic turn region was respectively created in white spot-like image faults. At a period corresponding to the outer peripheral length of the photosensitive member, white spots or white spot-like faults amounting to several millimeters sometimes occurred on an image. These are often seen from the initial stage of use of the charging device or form after the start of the operation after a long period of stoppage, and it has been found that they occur because the charging particles adhere to the photosensitive member.

In Example 1, however, such adherence is hardly seen and it is anticipated to be due to the effect of the lowering of the cohesion of the charging particles.

Comparative Example 2 is an example in which a conventional type particle charging apparatus is constructed in the image forming apparatus according to Embodiment 2 adopting a cleanerless process. It will be seen that as in Comparative Example 1, the degree of cohesion of the particles is high and the quality of image is fad. Particularly, the uniformity of the halftone image has lowered and all of black streaked faulty white spots have led to a bad result.

On the other hand, in the image forming apparatus according to Example 2 using the charging apparatus of the present invention, the quality of image is improved. It will be seen that in the cleanerless process as well, a reduction in the degree of cohesion of the charging particles is effective.

Further, in Example 3, the amount of surface treatment has been increased and the charging particles have been constituted by charging particles low in the degree of cohesion, whereby an improvement in the quality of image has been obtained. In the comparison between Examples 2 and 3, it can be confirmed that the two are the same in rank, but Example 3 is more improved.

Comparative Example 3 uses charging particles having a particle diameter of 1.8 μm. Considering that the cohering phenomenon is due to the adhesion between particles, it is anticipated that the larger becomes the particle diameter, the more decreased is the contact density between particles and therefore it becomes difficult for cohesion to occur. In Comparative Example 3, however, the lowering of the degree of cohesion was scarcely seen. An improvement in the rank of image evaluation was neither seen.

On the other hand, Example 4 shows charging particles having a particle diameter of 1.8 μm, and subjected to hydrophobic treatment, and the degree of cohesion thereof was 45%. When these particles were evaluated, an improvement in the quality of image could be achieved up to a rank B. As in Example 2, the hydrophobic treatment of the particles is effective to lower the degree of cohesion, whereby an improvement in the quality of image is considered to be obtained.

Further, in Examples 5 and 6, there can be confirmed the effect when silica particles were extraneously added to the surfaces of the charging particles. In Example 6, the degree of cohesion lowered to 25%, and the best result of image evaluation was shown. Particularly, the uniformity of the halftone image was greatly improved.

From the above-noted result, it will be seen that by the degree of cohesion of the charging particles being made equal to or less than 85%, and preferably equal to or less than 60%, there can be constructed an excellent charging device which does not cause fog and an fault in a halftone image even under a high-temperature high-humidity environment.

Besides, as far as the present invention is concerned, there is the contact condition of the charging roller. When the contact pressure of the roller is high or the foamed diameter of the roller is large, cohering lumps become liable to be formed on the charging roller and cohering lumps of particles having come off become liable to occur. Also, as regards the coming-off, the behavior of a roller downstream of the charging contact portion n is important and in that sense, it is anticipated that the degree of deformation and the frictional state of the roller are relevant.

As a result of an experiment, the appropriate ranges of these are as follows.

The cell diameter of the charging roller may preferably be 200 μm or less. When it was larger than 200 μm, a large cohering lump was formed on the roller, thus resulting in the deterioration of the quality of image. That is, 1 to 200 μm is a preferable range. Further, in Embodiment 2, the untransferred toner intervenes and therefore, it is necessary for the roller to collect the toner temporarily. If the toner cannot be collected, the toner comes off from the roller and therefore the uniformity of the halftone may sometimes be spoiled. From this point of view, it is preferable that the cell diameter be 50 μm or larger.

Accordingly, in Embodiment 2, 50 to 200 μm is an appriate range.

As the contact condition of the roller, 3 g/mm$^2$ or less is preferable. If 3 g/mm$^2$ is exceeded, it is anticipated that the cohesion of the particles due to the pressure of the roller is increased with a result that cohering lumps also become many in the particles which have come off. Also, the contact pressure necessary for the charging of the member to be charged is 0.5 g/mm$^2$ and therefore, the proper value of the contact pressure is within a range of 0.5 to 3 g/mm$^2$. In the present embodiment, the pressure contact was 1.7 g/mm$^2$.

Also, as the hardness of the roller, 15 degrees to 25 degrees in terms of Asker C hardness is preferable.

Even if the above-described roller pressure condition is satisfied, if the hardness of the roller is great, a change in the pressure distribution in the contact portion is great and a portion locally reaching great pressure is created. This tends to be liable to form cohering lamps.

Other Embodiments

1) While in the above-described embodiments, a laser printer has been exemplarily shown as the image recording apparatus, this is not restrictive, but of course, the image recording apparatus may be other image recording apparatus (image forming apparatus) such as an electrophotographic copying machine, a facsimile apparatus or a word processor, or an image display apparatus (display apparatus) such an electronic blackboard, or the like.

2) The exposure mean for forming an electrostatic latent image is not restricted to the laser scanning exposure means 3 for forming a digital latent image as in the above-described embodiments, but may be ordinary analog image exposure means or other light emitting element such as an LED, or may be any means which can form an electrostatic latent image corresponding to image information, such as a combination of a light emitting element such as a fluorescent lamp and a liquid crystal shutter or the like.

In the case of an electrostatic recording apparatus, the image bearing member as the member to be charged is an electrostatic recording dielectric member. In the case of the electrostatic recording dielectric member, it is uniformly charged to a predetermined polarity and potential by the charging apparatus, and the charged surface thereof is selectively de-electrified by de-electrifying means such as a de-electrifying needle array or an electron gun and an electrostatic latent image is written in and formed on it.

3) The image bearing member is not restricted to a drum type, but may also be of an endless belt type or a belt type having ends or a sheet-shaped type.

4) The contact charging member is not restricted to a roller type, but can also be of an endless belt type or a belt type having ends.

5) While in the above-described embodiments, the developing apparatus is a reversal developing apparatus using a single-component magnetic toner, the construction of the developing apparatus is not particularly restricted. It may be a normal developing apparatus.

Generally, the method of developing an electrostatic latent image is broadly classified into four kinds, i.e., a method of coating a developer bearing and conveying member such as a sleeve with a nonmagnetic toner by a blade or the like, or coating the developer bearing and conveying member with a magnetic toner by a magnetic force, and conveying the toner and applying it to an image bearing member in a non-contact state to thereby develop the electrostatic latent image (single-component non-contact developing), a method of applying the toner coating the developer bearing and conveying member as described above to the image bearing member in a contact state to thereby develop the electrostatic latent image (single-component contact developing), a method of using toner particles having a magnetic carrier mixed therewith as a developer (two-component developer) and conveying it and applying it to the image bearing member in a contact state to thereby develop the electrostatic latent image (two-component contact developing), and a method of applying the above-described two-component developer to the image bearing member in a non-contact state to thereby develop the electrostatic latent image (two-component non-contact developing). One of these four kinds of developing methods can be used in the developing apparatus in the above-described embodiments.

6) The transferring means is not restricted to roller transfer, but may also be belt transfer, corona transfer or the like. The image forming apparatus of the present invention may be an image forming apparatus using an intermediate transfer member (intermediate member to be transferred) such as a transfer drum or a transfer belt to form not only a single-color image but also a multicolor of full-color image by multiplex transfer or the like.

7) Direct injecting type charging has its charging mechanism residing in that charges more directly from the contact charging member to the member to be charged and therefore, it is necessary for the contact charging member to sufficiently contact with the surface of the member to be charged, and it is desirable that the contact charging member be rotated with a peripheral speed difference relative to the member to be charged. Specifically, the speed difference between the contact charging member and the member to be charged is provided by movingly driving the surface of the contact charging member to thereby provide a speed difference between it and the member to be charged. Preferably, the contact charging member may be rotatively driven and design may be made such that the direction of rotation thereof is opposite to the direction of movement of the surface of the member to be charged. It is also possible to move the surface of the contact charging member in the same direction as the direction of movement of the surface of the member to be charged to thereby provide a speed difference, but the charging property of the direct injecting type charging depends on the ratio between the peripheral speed of the member to be charged and the peripheral speed of the contact charging member and therefore, to obtain the same peripheral speed ratio as in the reverse direction, the number of revolutions of the contact charging member in the forward direction becomes great as compared with that in the reverse direction and therefore, it is more advantageous in respect of the number of revolutions to move the contact charging member in the opposite direction. The peripheral speed ratio described here is peripheral speed ratio=(peripheral speed of the contact charging member−peripheral speed of the member to be charged)/peripheral speed of the member to be charged×100 (the peripheral speed of the contact charging member is a positive value when in the contact portion, the surface of the contact charging member is moved in the same direction as the surface of the member to be charged).

8) Of course, the charging member or the charging apparatus of the present invention is not restricted to a charging apparatus for the image bearing member (such as an electrophotographic photosensitive member or an electrostatic recording dielectric member) of an image recording apparatus, but can be wide effectively used as charging process means (including a de-electrifying process) for the member to be charged.

As described above, in order to minimize the evil of the particles having come off in particle charging, the present invention has paid attention to the state of the charging particles having come off and has set the degree of cohesion of the charging particles to a predetermined amount or less to thereby realize the compatibility of the fog and the uniformity of a halftone image particularly under a high-temperature high-humidity environment, in the image recording apparatus.

Further, the lowering of the degree of cohesion is effective to improve the charging performance. Also, in the image recording apparatus, the charging particles adhering to the image bearing member as the member to be charged can also be prevented from shifting to other contact member, e.g. the transfer roller or the like and therefore, the adverse effect on other process could be reduced.

Further, the charging member of the present invention is also effective in an image recording apparatus using a toner recycle system, and by appropriately setting the degree of cohesion of the charging particles, there has been realized a charging member having high charging performance and excellent in a toner recycle property.

What is claimed is:

1. A charging member for charging a member to be charged, comprising:

electrically conductive particles with a degree of cohesion, which ranges from 0.1 to 85%; and an electrically conductive particle bearing member having elasticity and bearing said electrically conductive particles thereon, wherein the degree of cohesion of said electrically conductive particles is measured by vibrating a set screen combining meshes of 250 μm openings, 150 μm openings, and 75 μm openings, respectively, stacked in order from a top of the set screen.

2. A charging member according to claim 1, wherein a value obtained by dividing an amount of said electrically conductive particle borne by said electrically conductive particle bearing member by a surface roughness Ra (μm) of said electrically conductive particle bearing member is 0.005 to 1 $mg/cm^2/\mu m$.

3. A charging member according to claim 1, wherein an average particle diameter of said electrically conductive particles is 0.1 to 5 μm.

4. A charging member according to claim 1, wherein the degree of cohesion of said electrically conductive particles is 0.5 to 60%.

5. A charging member according to claim 1, wherein surfaces of said electrically conductive particles are subjected to hydrophobic treatment.

6. A charging member according to claim 1, wherein said electrically conductive particles are surface-treated by the use of a lubricant.

7. A charging member according to claim 1, wherein surfaces of said electrically conductive particles are subjected to hydrophobic treatment, and thereafter said electrically conductive particles are surface-treated by the use of a lubricant.

8. A charging member according to claim 1, wherein a resistance of said electrically conductive particles is $10^{-1}$ to $10^{12}$ Ω·cm.

9. A charging member according to claim 1, which brings said electrically conductive particles into contact with said member to be charged to thereby charge said member to be charged.

10. A charging member according to claim 1, wherein said electrically conductive particle bearing member is provided with a foamed layer on the surface thereof.

11. An image forming apparatus comprising:

a member to be charged capable of bearing an image thereon; and a charging member for bringing electrically conductive particles with a degree of cohesion, which ranges from 0.1 to 85% into contact with said member to be charged to thereby charge said member to be charged, said charging member including the electrically conductive particles and an electrically conductive particle bearing member having elasticity and bearing said electrically conductive particles thereon, wherein the degree of cohesion of said electrically conductive particles is measured by vibrating a set screen combining meshes of 250 μm openings, 150 μm openings, and 75 μm openings, respectively, stacked in order from a top of the set screen.

12. An image forming apparatus according to claim 11, wherein a value obtained by dividing an amount of said electrically conductive particles borne by said electrically conductive particle bearing member by a surface roughness Ra (μm) of said electrically conductive particle bearing member is 0.005 to 1 $mg/cm^2/\mu m$.

13. An image forming apparatus according to claim 11, wherein an average particle diameter of said electrically conductive particles is 0.1 to 5 μm.

14. An image forming apparatus according to claim 11, wherein the degree of cohesion of said electrically conductive particles is 0.5 to 60%.

15. An image forming apparatus according claim 11, wherein surfaces of said electrically conductive particles are subjected to hydrophobic treatment.

16. An image forming apparatus according to claim 11, wherein said electrically conductive particles are surface-treated by the use of a lubricant.

17. An image forming apparatus according to claim 11, wherein surfaces of said electrically conductive particles are subjected to hydrophobic treatment, and thereafter said electrically conductive particles are surface-treated by the use of a lubricant.

18. An image forming apparatus according to claim 11, wherein a resistance of said electrically conductive particles is $10^{-1}$ to $10^{12}$ Ω·cm.

19. An image forming apparatus according to claim 11, wherein said electrically conductive particle bearing member is provided with a foamed layer on the surface thereof.

20. An image forming apparatus according to claim 11, wherein said electrically conductive particle bearing member is moved with a peripheral speed difference relative to said member to be charged in a contact portion between said electrically conductive particle bearing member and said member to be charged.

21. An image forming apparatus according to claim 20, wherein said electrically conductive particle bearing member is rotated in a direction opposite to a direction of movement of said member to be charged in a contact portion between said electrically conductive particle bearing member and said member to be charged.

22. An image forming apparatus according to claim 11, further comprising developing means for developing an electrostatic image formed on said member to be charged by a developer, said developing means being capable of collecting a residual developer on said member to be charged.

23. An image forming apparatus according to claim 22, wherein said developing means is capable of supplying said electrically conductive particles to said member to be charged, and said electrically conductive particles supplied to said member to be charged are supplied to said electrically conductive particle bearing member.

* * * * *

UNITED STATES PATENT AND TRADEMARK OFFICE

CERTIFICATE OF CORRECTION

PATENT NO. : 6,847,796 B2
DATED : January 25, 2005
INVENTOR(S) : Yasunori Chigono et al.

It is certified that error appears in the above-identified patent and that said Letters Patent is hereby corrected as shown below:

Column 1,
Line 30, “I.” should read -- (I) --; and
Line 31, “II.” should read -- (II) --.

Column 2,
Line 57, “A.” should read -- (A) --; and
Line 31, “B.” should read -- (B) --.

Column 8,
Line 19, “Ω·cm” should read -- Ω·cm, --.

Column 9,
Line 2, “is” should be deleted.

Column 14,
Line 57, “g×1000.2” should read -- g×100×0.2 --.

Column 18,
Line 22, “nuch” should read -- such --.

Column 20,
Line 44, “are a” should read -- area --.

Column 24,
Line 50, “fad” should read -- bad --.

Column 26,
Line 13, “mean” should read -- means --.

Column 27,
Line 38, “is” should read -- is: --.

UNITED STATES PATENT AND TRADEMARK OFFICE

CERTIFICATE OF CORRECTION

PATENT NO. : 6,847,796 B2
DATED : January 25, 2005
INVENTOR(S) : Yasunori Chigono et al.

It is certified that error appears in the above-identified patent and that said Letters Patent is hereby corrected as shown below:

Column 28,
Line 8, "and" should read -- and being --.

Signed and Sealed this

Seventh Day of June, 2005

JON W. DUDAS
*Director of the United States Patent and Trademark Office*